United States Patent [19]

Schirmer

[11] Patent Number: 5,055,030

[45] Date of Patent: Oct. 8, 1991

[54] METHOD FOR THE RECOVERY OF HYDROCARBONS

[75] Inventor: Robert M. Schirmer, Sun City West, Ariz.

[73] Assignee: Phillips Petroleum Company, Bartlesville, Okla.

[21] Appl. No.: 370,957

[22] Filed: Jun. 23, 1989

Related U.S. Application Data

[62] Division of Ser. No. 354,858, Mar. 4, 1982, Pat. No. 4,861,263.

[51] Int. Cl.[5] ..... F23R 3/44

[52] U.S. Cl. ..... 431/10; 431/9; 431/158; 431/353; 431/190; 431/185; 60/39.05; 60/39.55; 122/31.1; 166/59

[58] Field of Search ..... 431/9, 10, 182, 183, 431/185, 190, 353, 158; 60/39.05, 39.55; 166/59, 303; 122/31.1, 31.2

[56] References Cited

U.S. PATENT DOCUMENTS

| | | | |
|---|---|---|---|
| 1,102,510 | 7/1914 | Irish | 431/183 |
| 2,995,895 | 8/1961 | Howes | 122/31.1 X |
| 3,456,721 | 7/1969 | Smith | 166/59 |
| 4,078,613 | 3/1978 | Hamrick et al. | 166/59 X |
| 4,120,640 | 10/1978 | Martin | 431/173 x |
| 4,385,661 | 5/1983 | Fox | 431/158 X |
| 4,411,618 | 10/1983 | Donaldson et al. | 431/158 X |
| 4,442,898 | 4/1984 | Wyatt | 431/158 X |
| 4,459,101 | 7/1984 | Doherty | 166/59 X |
| 4,861,263 | 8/1989 | Schirer | 431/158 |

FOREIGN PATENT DOCUMENTS

| | | | |
|---|---|---|---|
| 0162524 | 12/1980 | Japan | 431/163 |

*Primary Examiner*—Carl D. Price

*Attorney, Agent, or Firm*—George E. Bogatie

[57] ABSTRACT

A method and apparatus for recovering hydrocarbons in a which a first toroidal vortex of fuel and a combustion supporting gas is created with its center adjacent the axis of an elongated combustor; a second toroidal vortex of combustion supporting gas is generated between the first toroidal vortex; the fuel is burned in the presence of the combustion supporting gas to produce a fuel gas at the downstream end of the combustor; water is introduced into the flue gas adjacent the downstream end of the combustion to produce a mixture of flue gas and water; a major portion of the water is vaporized in a vaporizor to produce a mixture of flue gas and steam; and the mixture of flue gas and steam is injected into a hydrocarbon bearing formation.

32 Claims, 17 Drawing Sheets

METHOD FOR THE RECOVERY OF HYDROCARBONS

This is a division of application Ser. No. 354,858, filed Mar. 4, 1982, now U.S. Pat. No. 4,861,263.

The present invention relates to the method and apparatus for the recovery of hydrocarbons. More specifically, the present invention relates to a method and apparatus for the recovery of hydrocarbons by the use of steam.

BACKGROUND OF THE INVENTION

With the rapidly declining availability of hydrocarbon fuels, particularly from petroleum sources, there is a great need to extend efforts for the recovery of the petroleum to sources heretofore practically or economically unattractive and to the recovery of hydrocarbon fuels from alternate sources. A major potential source of petroleum, which has heretofore been virtually untapped because of the inability of most refineries to handle such crudes and the inability and expense of recovering them, are heavy oil deposits. Two basic methods have heretofore been applied in the recovery of such heavy oil deposits, namely; in situ combustion and steam injection methods. Both of these techniques have been limited by the fact that both require the burning of substantial amounts of the oil itself, or equivalent fuels, in order to reduce their viscosity and permit production thereof. This is true even with increased prices of oil. For example, to evaluate the economics of steam injection, the oil/steam ratio (OSR) is utilized. The OSR is the ratio of additional oil recovered for each ton of steam injected. Since it is necessary to burn about eight tons of fuel to get one hundred tons of steam, an OSR of 0.08 has a thermal balance of 0; i.e., you burn as much oil to generate the steam as you produce. Generally, wells in the Kern River Field of California operate with an OSR of 0.24, and are abandoned when they get below 0.15.

However, with the decontrol of heavy oil prices several years ago, substantial work has been done and commercial operations are presently under way utilizing steam recovery techniques for the recovery of heavy oil. In addition, the technology has progressed to the point where application of steam technology to other resource areas such as tar sands, diatomaceous earth, oil shale, and even residual light oil are technically feasible. However, until fairly recently, the state of the art techniques for heavy oil production by steam injection have produced only about 40% to 55% of the oil in place. This of course, is close to the ragged edge of being economic and leaves substantial volumes of oil unrecovered.

Most commercial operations, at the present time, are confined to the use of conventional steam boilers for the generation of steam. Usually, the lease crude is used as a fuel. However, when one considers that 80% to 85% of the cost of a steam injection operation is cost of the fuel, this obviously is a major factor. As a result, a number of alternate energy sources, some rather exotic, have been suggested, including petroleum coke, low BTU lignite coal, natural gas, almond hulls and tree prunings, solar energy, etc. However, except for solar energy, all suggested and used sources of energy for steam generation have the same problems and disadvantages.

First of all, conventional steam boilers waste about 19% of the fuel value in stack losses, about 3% to 20%, commonly 13% in flow lines from the boiler to the wellhead and about 3% in the well bore at depths up to about 2900 feet and about 20% at depths below 2900 feet. As a matter of fact, at depths below 2900 feet, the steam has generally degraded to hot water. Considerable work has been done and some progress made in the elimination of well bore losses by the use of insulated tubing for the injection of steam. However, it is generally accepted that the practical limit for conventional steam injection is about 2,000 to 2,500 feet. This limit, of course, eliminates substantial volumes of heavy oil below this depth. For example, the National Petroleum Council has recently estimated that there are from about 1.6 to 2.1 billion barrels of heavy oil in California, Texas and Louisiana alone, which are not recoverable by conventional steaming methods.

In addition, numerous heavy oil reservoirs will not respond to conventional steam injection since many have little or no natural drive pressure of their own and even when reservoir pressure is initially sufficient for production, the pressure obviously declines as production progresses. Consequently, conventional steaming techniques are of little value in these cases, since the steam produced is at a low pressure, for example, several atmospheres. Consequently, continuous injection of steam or a "steam drive" is generally out of the question. As a result, a cyclic technique, commonly known as "huff and puff" has been adopted in many steam injection operations. In this technique, steam is injected for a predetermined period of time, steam injection is discontinued and the well shut in for a predetermined period of time, referred to as a "soak". Thereafter, the well is pumped to a predetermined depletion point and the cycle repeated. This technique has the disadvantages that it depends for the recovery of oil, solely on a decrease in viscosity of the oil and the steam penetrates only a very small portion of the formation surrounding the well bore, particularly since the steam is at a relatively low pressure.

There are also known to be large amounts of untapped heavy oil in offshore locations. To date there have been no efforts to even test steaming in these reservoirs. Conventional boilers are obviously too large for offshore production platforms, even though it has recently been proposed to cantilever such a steam generator off the side of a production platform. However, in addition, such conventional steaming methods raise complex heat loss problems. Further, conventional boilers cannot use sea water as a source of steam because of the obvious fouling and rapid destruction of the boiler tubes.

However, the most formidable problem with conventional steam generation techniques is the production of air pollutants, namely, $SO_2$, $NO_x$ and particulate emissions. By way of example, it has been estimated that when burning crude oil having a sulfur content of about 2%, without flue gas desulfurization and utilizing 0.3 barrels of oil as fuel per barrel of oil produced, air emissions in a San Joaquin Valley, Calif. operation would amount to about 40 pounds of hydrocarbons, 4,000 pounds of $SO_2$, 800 pounds of $NO_x$ and 180 pounds of particulates per 1,000 barrels of oil produced. When these figures are multiplied in a large operation and a number of such operations exist in a single field, the problems can readily be appreciated. Consequently, under the Clean Air Act, the Environmental Protection Agency has set maximum emissions for such steaming operations, which are generally applied area wide, and states, such as California where large heavy oil fields exist and steaming operations are conducted on a commercial scale, have even more stringent limitations. Consequently, the number of steaming operations in a given field have been severely limited and in some cases it has been necessary to completely shut down an operation. The alternative is to equip the generators with expensive stack gas scrubbers for the removal of $SO_2$ and particulates and to adopt sophisticated $NO_x$ control techniques. This, of course, is a sufficiently large cost to make many operations uneconomic. Further, such scrubbers also result in the production of toxic chemicals which must be disposed of in toxic chemical dumps or in disposal wells where there is no chance that they will pollute ground waters.

Another solution to the previously mentioned well bore losses has been proposed in which a low pressure or burner is lowered down the well to generate steam adjacent the formation into which the steam is to be injected. The flue gas or combustion products are then returned to the surface. This, of course, has the definite disadvantages that the flue gas or combustion products must be cleaned up at the surface in the same manner, probably at the same cost as surface generation systems. Further, the low volumetric rate of heat release attainable in such a burner severely limits the rate of steaming or requires a much larger diameter well.

It has also been proposed to utilize high pressure combustion systems at the surface of the earth. Such a system differs from the low pressure technique to the extent that the water is vaporized by the flue gases from the combustor and both the flue gas and the steam are injected down the well bore. This has been found to essentially eliminate, or at least reduce or delay, the necessity of stack gas clean up and use of $NO_x$ reduction techniques. The mixture conventionally has a composition of about 60% to 70% steam, 25% to 35% nitrogen, about 4% to 5% carbon dioxide, about 1% to 3% oxygen, depending upon the excess of oxygen employed for complete combustion, and traces of $SO_2$ and $NO_x$. The $SO_2$ and $NO_x$, of course, create acidic materials. However, potential corrosion effects of these materials can be substantially reduced or even eliminated by proper treatment of the water used to produce the steam. There is a recognized bonus to such an operation, where a combination of steam, nitrogen and carbon dioxide are utilized, as opposed to steam alone. In addition to heating the reservoir and oil in place by condensation of the steam, the carbon dioxide dissolves in the oil, particularly in areas of the reservoir ahead of the steam where the oil is cold and the nitrogen pressurizes or repressurizes the reservoir. In fact, in certain types of reservoirs it is believed that the nitrogen creates artifical gas caps which aid in production. As a result of field tests, it has been shown that the high pressure technique results in at least a 100% increase in oil production over the use of steam alone and shortening the time of recovery to about two-thirds of that for steam injection alone. Such tests have generally been confined to injection of steam utilizing the "huff and puff" technique, primarily because results are forthcoming in a shorter period of time and comparisons can be readily made. However, utilization of the high pressure technique in steam drive operations should result in even further improvements. A very serious problem, however, with the currently proposed above ground high pressure system is that it involves a large hot gas generator operating at high pressures and high temperatures. This creates serious safety hazards and, when operated by unskilled oil field personnel, can have the potential of a bomb. One solution to the problems of the heat losses, during surface generation and transmittal of the steam-flue gas mixture down the well, and air pollution, by generating equipment located at the surface, is to lower a combustor-steam generator down the well bore to a point adjacent the formation to be steamed and inject a mixture of steam and flue gas into the formation. This also has the above-mentioned advantages of lowering the depth at which steaming can be economically and practically feasible and improving the rate and quantity of production by the injection of the steam-flue gas mixture. Such a technique was originally proposed by R. V. Smith in U.S. Pat. No. 3,456,721. If such an operation is also carried out in a manner to achieve high pressure, the reservoir can also be pressurized or repressurized. Extensive work has been conducted on this last technique for the U.S. Department of Energy's Division of Fossil Fuel Extraction. While most of the problems associated with such a system have been recognized, by these and other prior art workers, to date practical solutions to these problems have not been forthcoming. In order to be effective, for steam injection, the power output of the combustor should be at least equivalent to the output of current surface generating equipment, generally above about 7 MM Btu/hr. In order to be useful in a sufficiently large number of reservoirs, the output pressure must be above about 300 psi. The combustor must also be precisely controlled so as to maintain flame stability and prevent flame out, etc. Such control must also be exercised in feeding and maintaining proper flow of fuel and combustion supporting gas and combustion stoichiometry for efficient and complete combustion, thereby eliminating incomplete combustion with the attendant production of soot and other particulate materials, since excessive amounts of combustion supporting gas for stoichiometric combustion could contribute to corrosion and excessive amounts of fuel result in incomplete combustion and the production of soot and other particulates. A further problem is the construction of the combustor and its operation to prevent rapid deterioration of the combustion chamber and the deposition of carbonaceous materials on the walls of the combustion chamber. Thus, proper cooling of the combustion chamber is necessary, as well as protection of the walls of the combustion chamber. Efficient evaporation and control of the water are also necessary to produce dry, clean steam. Unless the combustor is properly controlled, in addition to introducing the water into the flue gas properly, the water will prematurely dilute the combustion mixture, resulting in incomplete combustion and creation of the water-gas reaction, as opposed to combustion, and prematurely cool the combustion mixture, again producing excessive soot and particulates. All of these last mentioned problems are greatly compounded by size limitations on the generator. Usually, wells will be drilled and set with casing having an internal diameter of 13" or less and in most cases, less than 7". Thus, the downhole generator should have a maximum diameter to fit in 13" casing and most preferably to fit into a 7" casing. Obviously, the tool should be durable and capable of many start-ups, thousands of operating hours and many shutdowns. Again, because of the nature of the operation, the tool should be designed to be flexible in construction, to permit ready inspection, repair and adjustment. Finally, the tool should be capable of operating on a wide variety of different fuels. In this regard, most proposed tools are designed for and capable of using only one specific fuel.

It is therefore and object of the present invention, to overcome the above-mentioned and other disadvantages of the prior art. Another object of the present invention is to provide an improved method and apparatus for the generation of steam for hydrocarbon recovery which reduces heat losses. A further object of the present invention is to provide an improved method and apparatus for generating steam for hydrocarbon recovery which can be utilizable in deep reservoirs. Another and further object of the present invention is to provide an improved method and apparatus for generating steam for hydrocarbon recovery capable of pressurizing and/or repressurizing petroleum reservoirs. Yet another object of the present invention is to provide improved method and apparatus for generating steam for hydrocarbon recovery which can conveniently be utilized in offshore operations. A further object of the present invention is to provide an improved method and apparatus for the generation of steam for hydrocarbon recovery which is capable of utilizing impure water, such as sea water. A still further object of the present invention is to provide an improved method and apparatus for generating steam for hydrocarbon recovery which greatly reduces or delays environmental pollution. Yet another object of the present invention is to provide an improved method and apparatus for generating steam for hydrocarbon recovery which is safe to use, both in a well bore and at the surface of the earth. Another object of the present invention is to provide an improved method and apparatus for generating steam for hydrocarbon recovery including a combustor having a high power output. A further object of the present invention is to provide an improved method and apparatus for the production of steam for hydrocarbon recovery capable of operating at a high pressure. Another and further object of the present invention is to provide an improved method and apparatus for the production of steam for hydrocarbon recovery, including a combustor having a high combustion stability and combustion efficiency. A still further object of the present invention is to provide an improved method and apparatus for the generation of steam for the recovery of hydrocarbons including a combustor which can be readily controlled with respect to the introduction of a fuel and combustion supporting gas and the control of the stiochiometry thereof, whereby a flue gas with minimal quantities of soot and other particulates is produced. Yet another object of the present invention is to provide an improved method and apparatus for the generation of steam for a hydrocarbon recovery including a combustor capable of operating for extended periods of time and with minimal damage to and deposits on the combustor walls. Another and further object of the present invention is to provide an improved method and apparatus for the generation of steam for hydrocarbon recovery capable of producing clean, dry steam. A further object of the present invention is to provide an improved method and apparatus for the generation of steam for hydrocarbon recovery capable of efficient and complete production of steam. Yet another object of the present invention is to provide an improved method and apparatus for the generation of steam for hydrocarbon recovery wherein water for the production of steam is introduced in a manner which prevents the interference of the water with combustion and effectively mixes the water with combustion products. A still further object of the present invention is to provide an improved method and apparatus for the generation of steam for hydrocarbon recovery capable of attaining a uniform temperature distribution across the outlet thereof. A further object of the present invention is to provide an improved method and apparatus for the generation of steam for hydrocarbon recovery wherein the combustor is effectively cooled. Another object of the present invention is to provide an improved method and apparatus for the generation of steam for hydrocarbon recovery which is capable of use in the small diameter well bores. Still another object of the present invention is to provide an improved method and apparatus for the generation of steam for hydrocarbon recovery whose components are flexibly combined to permit ready inspection, repair and modification. A still further object of the present invention is to provide an improved method and apparatus for the generation of steam for hydrocarbon recovery which is capable of and/or convertible to the use of a wide variety of different fuels. These and other objects of the present invention will be apparent from the following description.

SUMMARY OF THE INVENTION

In accordance with the present invention, the flame in an elongated combustion chamber is stabilized, while simultaneously reducing formation of deposits on the inner wall of the combustion chamber, by creating a first toroidal vortex of fuel and a first volume of combustion supporting gas, having its center adjacent the axis of the combustion chamber and rotating in one of a clockwise or counterclockwise direction, and moving from the inlet end of the combustion chamber toward the outlet end of the combustion chamber, creating a second toroidal vortex of a second volume of a combustion supporting gas, between the first toroidal vortex and the inner wall of the combustion chamber and rotating in the other of the clockwise or counterclockwise direction, and moving from the inlet end of the combustion chamber to the outlet end of the combustion chamber to produce a confined annular body of the second volume of combustion supporting gas; and burning the fuel in the presence of the first and second volumes of combustion supporting gas to produce a flame moving from the inlet end of the combustion chamber toward the outlet end of the combustion chamber and a flue gas adjacent the outlet end of the combustion chamber substantially free of unburned fuel. In another aspect of the present invention, a fuel is burned in a combustion chamber in the presence of a combustion supporting gas to produce a flue gas substantially free of unburned fuel at the outlet end of the combustion chamber and steam is generated by introducing water, in a generally radial direction, into the flue gas adjacent the downstream end of the combustion chamber to produce a mixture of flue gas and water and vaporize a major portion of the water to produce a mixture of flue gas and steam. In yet another aspect of the present invention, steam is generated by burning a fuel in the presence of a combustion supporting gas in a combustion chamber to produce a flue gas at the downstream end of the combustion chamber, steam is generated by introducing water into the flue gas adjacent the downstream end of the combustion chamber, the mixture of flue gas and water is passed through a vaporization chamber to vaporize a major portion of the water and produce a mixture of flue gas and steam and the outlet pressure at the downstream end of the vaporization chamber is varied to control said outlet pressure. The apparatus includes a modular steam generating means, including a combustor head, having fuel introduction means and combustion supporting gas introduction means; a combustion chamber for burning the fuel in the presence of the combustion supporting gas, and including means for introducing water into the flue gas at the downstream end of the combustion chamber; and a vaporization chamber for vaporizing a major portion of the water to produce a mixture of flue gas and steam.

DESCRIPTION OF THE PREFERRED EMBODIMENTS

Figure 1:
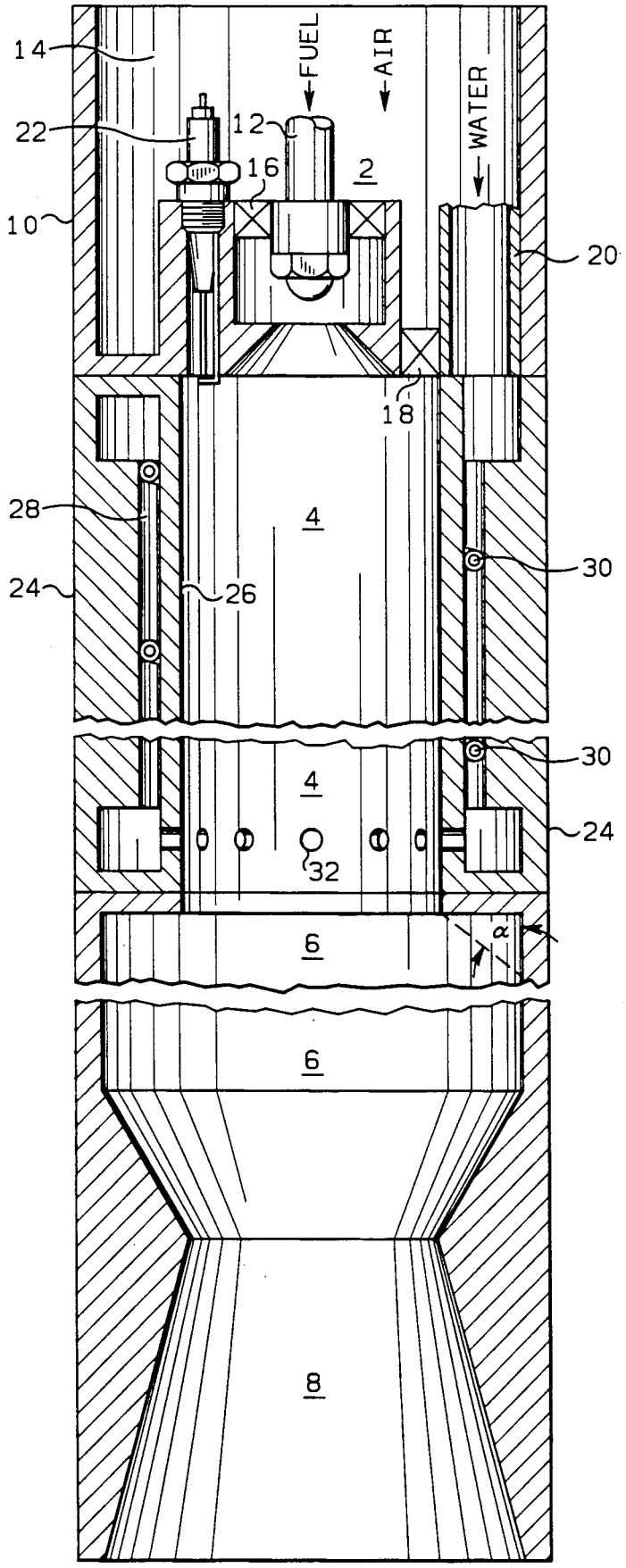
FIG. 1 of the drawings is an elevational view, partially in section, of a basic combustor and steam generator in accordance with the present invention.

The flame in an elongated combustion chamber is stabilized while simultaneously reducing the deposition of the deposits on the inner walls of the combustion chamber, in accordance with the present invention, by creating a first toroidal vortex of fuel and a first volume of combustion supporting gas, having its center adjacent the axis of the combustion chamber and rotating in one of a clockwise or counterclockwise direction, and moving from the inlet end of the combustion chamber toward the outlet end of the combustion chamber; creating a second toroidal vortex of a second volume of combustion supporting gas, between the first toroidal vortex and the inner wall of the combustion chamber and rotating in the other of the clockwise or counterclockwise direction to produce a confined annular body of the second volume of combustion supporting gas, moving from the inlet end of the combustion chamber to the outlet end of the combustion chamber; and burning the fuel in the presence of the first and second volumes of combustion supporting gas to produce a flame moving from the inlet end of the combustion chamber to the outlet end of the combustion chamber and a flue gas substantially free of unburned fuel at the downstream end of the combustion chamber. The fuel may include any normally gaseous fuel, such as natural gas, propane, etc., any normally liquid fuel, such a No. 2 fuel oil, a No. 6 fuel oil, diesel fuels, crude oil, other hydrocarbon factions, shale oils, etc. or any normally solid, essentially ashless fuels, such as solvent refined coal oil, asphaltine bottoms, etc. The combustion supporting gas is preferably air. In order to produce a flue gas substantially free of unburned fuel, an excess of air is utilized, preferably about 3% excess oxygen on a dry basis, above the stoichiometric amount necessary for complete combustion of all of the fuel. The relative volumes of the second volume of air and the first volume of air are between about 0 and 75% and between about 25% and 100%, respectively. Where the fuel employed is a normally gaseous fuel, the second volume of air is not necessary and, therefore, the minimum amount of the second volume of air is 0. However, where normally liquid or a normally solid fuels, which form deposits on combustors, is employed, the minimum amount of the second volume of air should be a small amount sufficient to form the annular body of the second volume of air between the first torroidal vortex and the inner wall of the combustion chamber. Preferably, the volume of the second volume of air is between about 50% and 75% and the volume of the first volume of air is between about 25% and 50% of the total volume of the first and second volumes of air. Where the fuel is a normally liquid fuel, the fuel is preferably introduced by means of a spray nozzle adapted to produce droplet sizes below about 70 microns and the fuel should have a viscosity below about 40 cS, preferably below about 20 cS, still more preferably below about 7 cS and ideally below about 3 cS. Such droplet size can be produced by utilizing an air assisted nozzle, which also preferably sprays the fuel into the combustion chamber at a diverging angle, having an apex angle preferably of about 90°. The fuel may also be preheated to a temperature between ambient temperature and about 450° F. and preferably between ambient temperature and about 250° F. The limit of about 250° F. is generally dictated for fuels which are normally subject to cracking and thus producing excessive amounts of deposits. The viscosity of the heavier fuels may also be reduced by blending lighter fuels therewith, for example, by blending fuel oils with heavy crude oils. The air is also preferably preheated between ambient temperature and adiabatic temperature, preferably between ambient temperature and about 800° F. and still more preferably between about 200° F. and about 500° F. The flow velocity in the combustor is maintained above laminar flow flame speed. Generally, laminar flow flame speed, for liquid hydrocarbon fuels, is between about 1.2 and 1.3 ft./sec. and, for natural gas, is about 1.2 ft./sec. Consequently, the reference velocity (cold flow) maintained in the combustion chamber should be between about 1 and 200 ft. per second, preferably between about 10 and 200 ft. per second and still more preferably, between about 50 and 100 ft. per second, depending upon desired heat output of the combustor. The flow velocity, at flame temperature, should be between about 5 and 1,000 ft. per second, preferably between 50 and 1,000 ft. per second and still more preferably, between about 100 and 500 ft. per second. The method of burning fuel, in accordance with the present invention, is particularly useful for the generation of steam to produce a mixture of flue gas and steam for injection into heavy oil reservoirs. For this purpose, the power output should be at least about 7 MM Btu/hr. for effective and economical stimulation of a well in most heavy oil fields. Consequently, the heat release of the combustion process should be at least about 50 MM Btu/hr. ft.$^3$ Such a heat release rate is about 3 orders of magnitude greater than the heat release of typical oil-fired boilers currently in use in heavy oil recovery. The pressure of the mixture of flue gas and steam must be above about 300 psi for the fluids to penetrate the formation in most heavy oil fields. The steam generated may be between wet and superheat and preferably a vaporization of about 50% to superheat and still more preferably between 80% vaporization and superheat. For shale oil recovery, superheat of about 600° F. (an outlet temperature of about 1000° F.) is believed necessary.

The method of combustion and steam generation in accordance with the present invention is further illustrated by the following description of the apparatus in accordance with the present invention.

FIG. 1 of the drawings is a schematic drawing, in cross section, of a basic downhole steam generator, in accordance with the present invention. One of the distinct advantages of the basic steam generator is that it is capable of utilizing any readily available type of fuel, from gaseous fuels to solid fuels, with minor modifications pointed out hereinafter. In general, such modifications involve only replacement of the combustor head, and/or, in some cases, the combustion chamber. Accordingly, it is highly advantageous to attach the head to the main body of the device so that it may be removed and replaced by a head adapted for use of different types of fuels. It should also be recognized that the device is capable of use at the surface of the earth, as well as downhole, to meet the needs or demands or desires for a particular operation. In either event, the distinct advantage of injecting the combustion gases or flue gas along with steam would be retained. More specifically, the unit can be mounted in the wellhead with the combustor head and fluid inlet controls exposed for easier control or the entire unit could be connected to the wellhead by appropriate supply lines so that the entire unit would be available for observation and control. For example, sight glasses could be provided along the body at appropriate points in order to observe the flame, etc. It would also be possible in such case to monitor the character of the mixture of flue gas and steam being injected and therefore, make appropriate adjustments for control of the feed fluids. When utilized outside the well, it is desirable from a safety standpoint, to mount the unit in a section of pipe or casing. However, it should be recognized that when the unit is located at the surface or in the top of the well, the advantage of reducing heat losses, which occur during transmission of the fluids down the well, does not exist and preferably the line through which the fluids are passing from the surface to the producing formation should be appropriately insulated.

The generator comprises four basic sections or modules, namely, a combustor head 2, a combustion chamber 4, a water vaporization chamber 6 and an exhaust nozzle 8. As previously pointed out with respect to the combustor head, all of the modules are connected in a manner such that they are readily separable for the substitution of alternate subunits, servicing, repair, etc. In some cases, however, the combustion chamber 4 and water vaporization chamber 6 can be permanently connected subunits, since the unit can be designed so that these two subunits can be utilized for most types of fuel and most water injection and vaporization rates. In certain instances it may also be desirable to substitute a different exhaust nozzle or a different fuel introduction means. Details of all such modifications will be set forth hereinafter.

Air and fuel are brought to the combustor head 2 in near stoichoimetric quantities, generally with 3% excess oxygen on a dry basis. As previously indicated, the fuel can be gases, such as hydrogen, methane, propane, etc., liquid fuels, such as gasoline, kerosene, diesel fuel, heavy fuel oils, crude oil or other liquid hydrocarbon fractions, as well as normally solid fuels, such as solvent refined coal (SCR I), asphaltenes, such as asphaltene bottoms from oil extraction processes, water-fuel emulsions, for "explosive atomization", water-fuel solutions for "disruptive vaporization" of fuel droplets, etc. The head 2 has a body portion or outer casing 10. A fuel introduction means 12 is mounted along the axis of casing 10 to introduce fuel centrally and axially into the combustion chamber 4. In the particular instance schematically shown herein, the fuel introduction means 12 is an atomizing nozzle adapted for the introduction of a liquid fuel. Such atomizing nozzles are well known in the art and the details thereof need not be described herein. However, the nozzle may be any variety of spray nozzles or fluid assist nozzles, such as an air assist or steam assist nozzle. Obviously an air assist nozzle, where such assistance is necessary, is preferred if there is no readily available source of steam and to prevent dilution in the combustion chamber. This is particularly true where the unit is utilized downhole and surface steam is not readily available. It would then be necessary to recycle a part of the effluent steam to the steam assist nozzle, a more difficult and unnecessary task. In any event, the nozzle 12 sprays the appropriately atomized liquid fuel in a diverging pattern into the combustion chamber 4. Combustion supporting gas, particularly air, is introduced into a plenum chamber 14 formed within outer casing 10. Obviously, the plenum chamber 14 can be separated into two or more separate plenum chambers for introducing separate volumes of air, as hereinafter described. It is also possible to supply more than one volume of air through separate lines from the surface. This, of course, would provide separate control over each of a plurality of volumes of air beyond that controlled by the cross-sectional area of the air openings in each specific case. It is also possible that each of the air entries to the combustion chamber could be constructed to vary the cross-sectional area of air openings and could be remotely controlled in accordance with techniques known to those skilled in the art. In any event, a first volume of air is introduced around nozzle 12 through a swirler 16. Swirler 16 may be any appropriate air introduction swirler which will introduce the air in a swirling or rotating manner, axially into the combustion chamber 4 and in a downstream direction. The specific variations would include a plurality of fins at an appropriate angle, such as 45° (apex angle of 90°), or a plurality of tangentially disposed inlet channels. In any event, the air and fuel then enter combustion chamber 4 as a swirling or rotating core, rotating in a clockwise or counterclockwise direction. A second air swirler 18 is formed adjacent the inner wall of combustion chamber 4 and is of essentially the same construction as swirler 16. Swirler 18, in like manner to 16, introduces the air as a swirling or rotating body of air along the inner wall of combustion chamber 4. The rotation of the air by swirler 16 and swirler 18 are in opposite directions. Specifically, if the air is rotated in a clockwise direction by swirler 16, it should be rotated in a counterclockwise direction by swirler 18. This manner of introducing the air through swirlers is extremely important in the operation of the unit of the present invention, particularly where fuels having a tendency to deposit carbon and tar on hot surfaces are utilized and to prevent burning of the combustion chamber walls. Also introduced through combustor head 2 is water, through water inlet 20. Also mounted in the combustor head is a suitable lighter or ignition means 22. In the present embodiment, igniter means 22 is a spark plug. However, where fuels having high ignition temperatures are utilized, the igniter means may be a fuel assisted ignition means, such as a propane torch or the like which will operate until ignition of the fuel/air mixture occurs. In some cases, a significant amount of preheating of the fuel or fuel-air mixture is necessary.

The combustion chamber includes an outer casing 24 and an inner burner wall 26, which form an annular water passage 28 therebetween. Water passage 28 is supplied with water through water conduit 20 and cools the combustion chamber. This external cooling with water becomes a significant factor in a unit for downhole operation, since, in some cases, for example where the tool is to be run in a casing with an internal diameter of about 7 inches, the tool itself will have a diameter of 6 inches. This small diameter does not permit mechanical insulation of the combustion chamber and, accordingly, effective cooling is provided by the water. It should be recognized at this point that transfer of heat from the combustion chamber to the water in passage 28 is not necessary in order to vaporize the water since complete vaporization occurs downstream, as will be pointed out hereinafter. In order to prevent the formation of air bubbles or pockets in the body of cooling water, particularly toward the upper or upstream end of the channel, water swirling means 30 is spirally wound in the water channel 28 to direct the water in a spiral axial direction through the channel. The water swirling means 30 can be a simple piece of tubing or any other appropriate means. A primary concern in the operation of the generator is combustion cleanliness, that is the prevention of deposits on the wall of the combustion chamber and production of soot emissions as a result of incomplete combustion. This becomes a particular problem where heavy fuels are utilized and the problem is aggravated as combustor pressure increases and/or combustion temperature decreases. In any event, the manner of introducing the air into the generator substantially overcomes this problem. The counter rotating streams of air in the combustion chamber provide for flame stabilization in the vortex-flow pattern of the inner swirl with intense fuel-air mixing at the shear interface between the inner and outer streams of air for maximum fuel vaporization. Also, this pattern of air flow causes fuel-lean combustion along the combustion chamber walls to prevent build up of carbonaceous deposits, soot, etc. Following passage of the water through channel 28, the water is injected into the combustion products or flue gases from combustion chamber 4 through appropriate holes or apertures 32. Another extremely important factor, in the operation of the steam generator of the present invention, is the prevention of feedback of excessive amounts of water from the vaporization section 6 into the combustion section 4, because of the chilling effect which such feedback would have on the burning of the soot particles which are produced during high pressure combustion. Such feedback is prevented by the axial displacement of the vortex flow patterns from the counter rotational air flow. Another extremely important factor in the operation of the steam generator is the manner of introduction of water into the flue gas. In accordance with the present invention, such introduction is accomplished by introducing the water as radial jets into the flue gases, such jets preferably penetrating as close as possible to the center of the body of combustion products. The combustion products-water mixture is then abruptly expanded as it enters vaporization chamber 6. Accordingly, substantially complete vaporization will occur and the formation of water droplets or water slugging in the mixture will be eliminated. Abrupt expansion in the present case is meant to include expansion at an angle alpha significantly greater than 15°, since expansion at about 15° causes streamline flow or flow along the walls rather than reverse mixing at the expander. By the time the mixture of combustion products and water reach the downstream end of water vaporization chamber 6, substantially complete vaporization is attained. As will be discussed in greater detail hereinafter, exhaust nozzle 8, designed to discharge the combustion product-steam into the formation being treated, controls the pressure of discharge of the mixture. As has been pointed out previously and will be discussed in even greater detail hereinafter, the injection of both the steam and the combustion products into the formation has a number of very significant advantages, including elimination of air pollution and enhancement of oil recovery.

Figure 2:
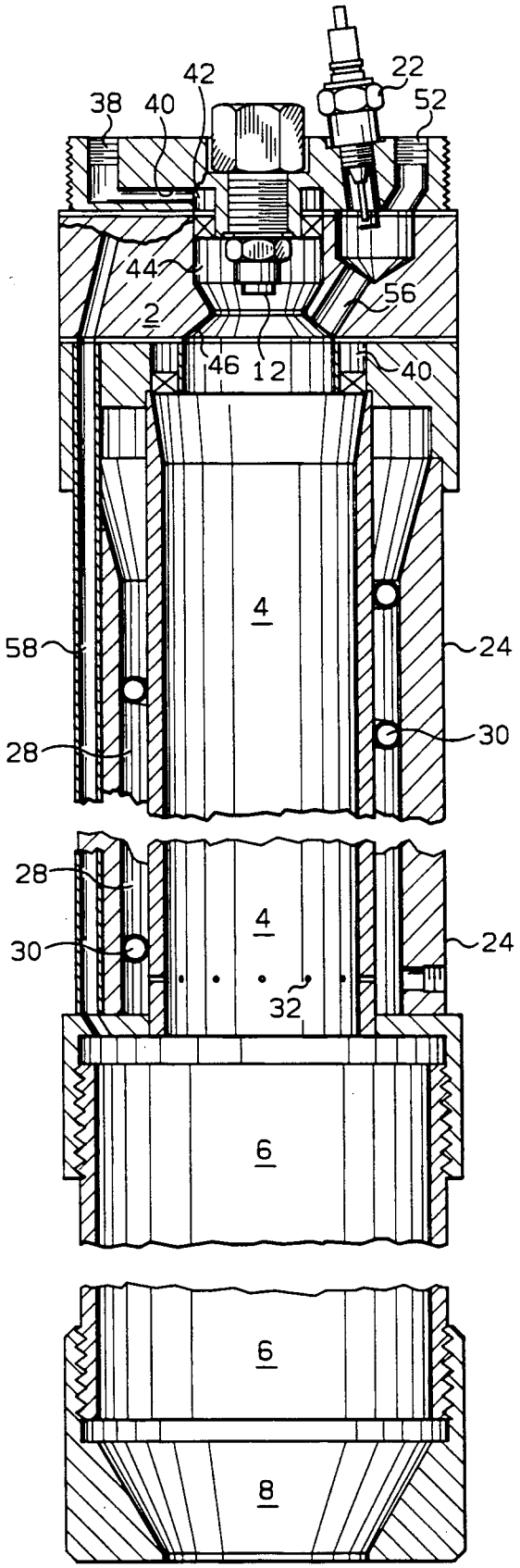
FIG. 2 is an elevational view, partially in cross section, showing the details of one embodiment of a combustor and steam generator in accordance with the present invention.
Figure 3:
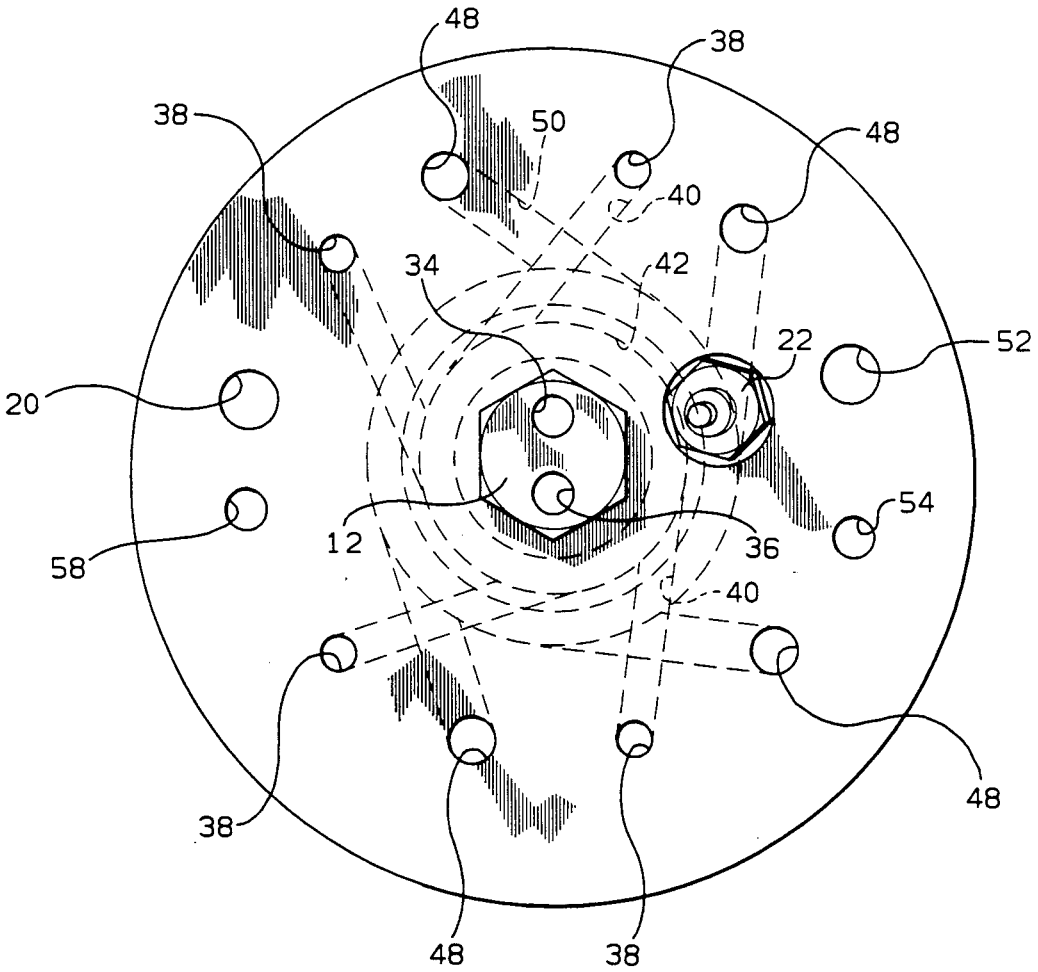
FIG. 3 is a top view of the combustor of FIG. 2.

FIG. 2 of the drawings is an elevational view, in cross section, showing in greater detail one embodiment of a combustor in accordance with the present invention. FIG. 3 is a top view of the generator of FIG. 2. As in FIG. 1, the generator of FIGS. 2 and 3, particularly the combustor head, is designed to burn liquid fuels.

Referring now to FIGS. 2 and 3, the nozzle 12 is supplied with fuel through longitudinally disposed bore 34 and with atomizing air through longitudinally disposed bore 36. Air atomizing or air assist nozzles are well known in the art, for example, a nozzle known as an "AIR BLAST NOZZLE", manufactured by the Delvan Manufacturing Company, West Des Moines, Iowa, has been found to be a highly effective air atomizing nozzle, particularly for use with heavy liquids. This particular nozzle is available for different flow capacities and fuel-air ratios. Combustion air is supplied from a common air plenum (not shown). As previously indicated, the first and second volumes of air could be supplied to individual air plenums, so that the relative volumes of air could be adjusted, rather than depending solely upon the relative open areas of the entries to the combustion chamber, or individual lines to each opening. In either event, the first volume of air is introduced through a plurality of vertically disposed channels 38.

From channel 38 the first volume of air flows through tangential channels 40 and thence to annular plenum chamber 42. Passage through the tangential channels 40 imparts a swirling or rotational motion to the air, in the case shown in FIG. 3, a counterclockwise rotation. The rotating air then enters mixing or contact chamber 44 where it begins contact with the fuel exiting from nozzle 12. The fuel exiting from nozzle 12, preferably exits the nozzle in a cone-shaped pattern having an angle, preferably of about 45°. The first volume of air from channel 40 is reduced in diameter by a baffle or nozzle-type restriction 46. This reduction in diameter of the air aids in the mixing of the combustion air and the fuel which begins at the downstream end of the mixing chamber 44. As the mixture of air and fuel expands into the exit end of mixing chamber 44, a well mixed mixture of fuel and air travels downstream into the combustion chamber 4 as a body of fluids rotating in a counterclockwise direction and moving axially through the combustion chamber. Normally, the larger diameter of combustion chamber 4 as opposed to mixing chamber 44 would cause expansion of the counterclockwise rotating mixture of fuel and air toward the walls of combustion chamber 4. However, in the present case, this is prevented to a great extent by the second volume of air. The second volume of air enters from the common plenum (not shown) through longitudinally disposed bores 48, thence through tangential bores 50 and into annular plenum 51. These supply channels for the second volume of air are substantially the same construction and character as those utilized for introducing the first volume of air, with the exception that the channels introducing the second volume of air cause the second volume of air to rotate in a clockwise direction or countercurrent to the direction of rotation of the first volume of air. The second volume of air in traveling downstream through combustion chamber 4 will have a tendency to move toward the axis of combustion chamber 4 and, as previously indicated, the first volume of air will have a tendency to move toward the walls of combustion chamber 4, thus a high velocity shear surface exists between the two countercurrently flowing volumes of fluid and the hottest portion or core of the flame traveling along the axis does not contact the walls of the combustion chamber, thereby preventing burning of the walls and the formation of deposits along the walls, particularly where heavy fuels are utilized. However, the intense mixing which occurs at the interface between the two volumes of fluids does create considerable mixing and by the time the two volumes reach the downstream end of combustion chamber 4, substantially complete mixing has occured and therefore substantially complete combustion. In addition, the central vortex has also essentially collapsed and a uniform, cross section or "plug" flow of flue gas exists. Lighting or ignition of the generator is accomplished by supplying a gaseous fuel through channel 52 and air through channel 54, which contact one another adjacent the downstream end of spark plug 22. This burning flame then passes through channel 56 into mixing chamber 44 where it ignites the first volume of air-fuel mixture in mixing chamber 44. Channel 58 passes through combustor head 2, through the casing 24 of the combustion chamber 4 and thence into the interior of water vaporization chamber 6. Channel 58 is utilized for the insertion of a thermocouple into water vaporization chamber 6.

Figure 4:
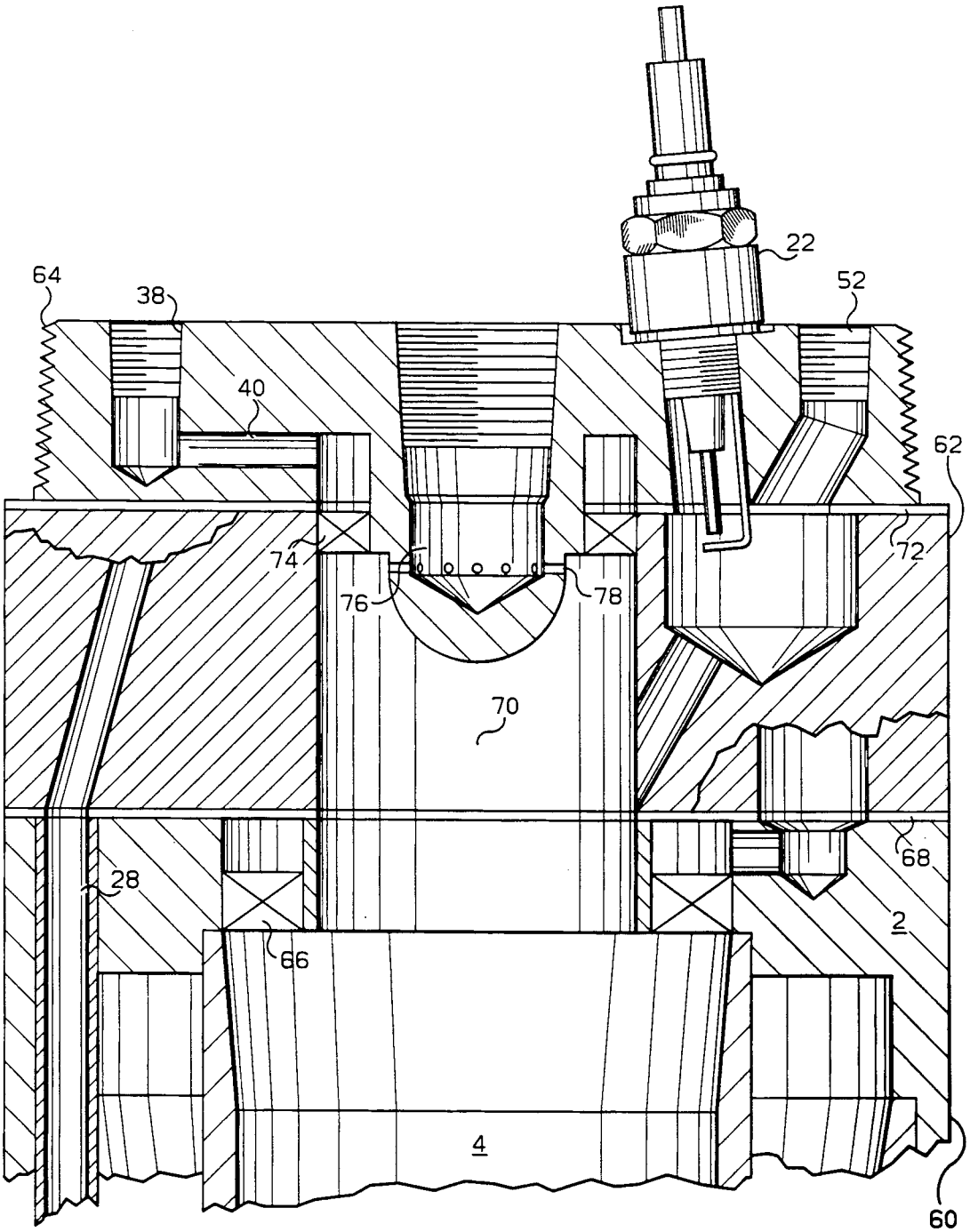
FIG. 4 is an elevational view, partially in section, of a combustor head in accordance with another embodiment of the present invention.

FIG. 4 is a partial elevational view of a steam generator, in accordance with the present invention, shown in partial cross section. The particular combustor head shown in FIG. 4 is designed for use of a gaseous fuel, such as natural gas. Primarily, the differences between this and the previously described combustor head lie in the fuel nozzle, the swirlers and the mixing chamber. Where appropriate, numbers corresponding to those utilized in FIGS. 2 and 3 are utilized on corresponding parts in FIG. 4. The adaptability of the generator of the present invention to replacement of modified parts is also discussed in greater detail with relation to FIG. 4.

Referring specifically to FIG. 4, combustor head 2 can be constructed, as shown, in three separate sections, namely, a downstream section 60, a middle section 62 and an upstream section 64. In this particular instance, section 60 is welded to combustion chamber 4. However, as will be pointed out hereinafter, swirler 66, shown schematically and described hereinafter, can be readily inserted in downstream section 60 before section 62 and 64 are attached thereto. An appropriate gasket 68 is mounted between downstream section 60 and middle section 62 and section 62 mounted on section 60 by means of appropriate threaded bolts. Section 60, as is obvious, also has formed therein the downstream end of a modified mixing chamber 70. This downstream portion of mixing section 70 is the same as the downstream mixing portion of mixing chamber 44 of FIG. 2, and, therefore, section 60 need not be modified except for the swirler in order to substitute corresponding parts of the device of FIG. 2 and provide a modified mixing chamber 70. Mixing chamber 70 of FIG. 4 does not contain the restriction means 46 of FIG. 2, since a gaseous fuel is utilized in FIG. 4 and complete mixing can be obtained with the air without the use of restriction 46 (FIG. 2). Section 64 of the combustor head 2 is similarly attached to section 62 through a gasket 72 therebetween. A modified swirler 74, shown schematically, is similar to swirler 66 and can be readily mounted in section 62 prior to the attachment of section 64. Section 64 has mounted axially therein a modified nozzle 76. Since a gaseous fuel is to be utilized in the present invention, a simple nozzle 76 with apertures 78 radiating therefrom and feeding gaseous fuel into mixing chamber 70 can be utilized. It is also obvious that either nozzle 12 of FIG. 2 and 3 or nozzle 76 of FIG. 4 can be threadedly mounted in section 64, thereby requiring only replacement of the nozzle if desired. A torch igniter, as shown, may be utilized in this embodiment or a simple electrode or spark plug as shown in FIG. 1. Section 64 contains the same air channels 38 and 40 as the combustion head of FIG. 2, but it is not necessary that tangential channels 40 be utilized for the reasons pointed out in the discussion of swirlers 66 and 74.

Figure 6:
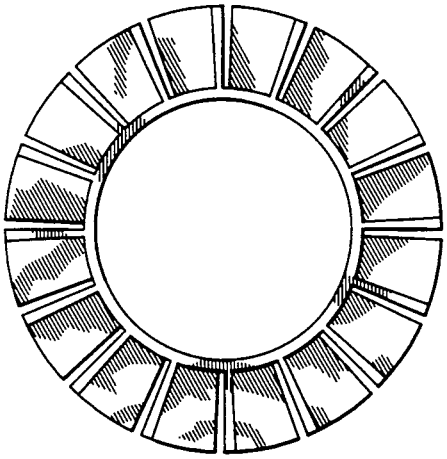
FIGS. 5 and 6 are a side view and top view respectively of means for rotating air introduced to a combustor in accordance with the present invention.
Figure 5:
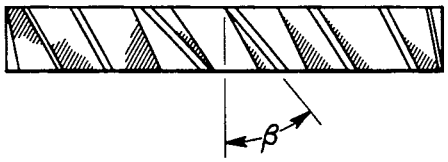

FIG. 5 shows a side view and FIG. 6 a top view of the modified swirlers 66 and 74 of FIG. 4. It is to be noted that the swirlers of FIGS. 5 and 6 include a simple internal ring with blades or fins radiating therefrom and at an appropriate angle. In the present case, the angle beta is 45°. Accordingly, the ring of FIGS. 5 and 6 serves the same purpose as the tangential channels 40 and 50 of FIGS. 2 and 3. In addition, these rings can be simply mounted in Sections 60 and 62 in combustor head 2 prior to the assembly thereof. As previously indicated, when utilizing the swirler rings of FIGS. 5 and 6, the tangential air introduction is not necessary, but may be retained for convenience of manufacture without adversely affecting the operation of the device. In any event, the swirlers 74 and 66 introduce the first and second volumes of air, respectively, in a rotating, axial direction toward the downstream end of a combustor and in a counter rotative direction.

Figure 7:
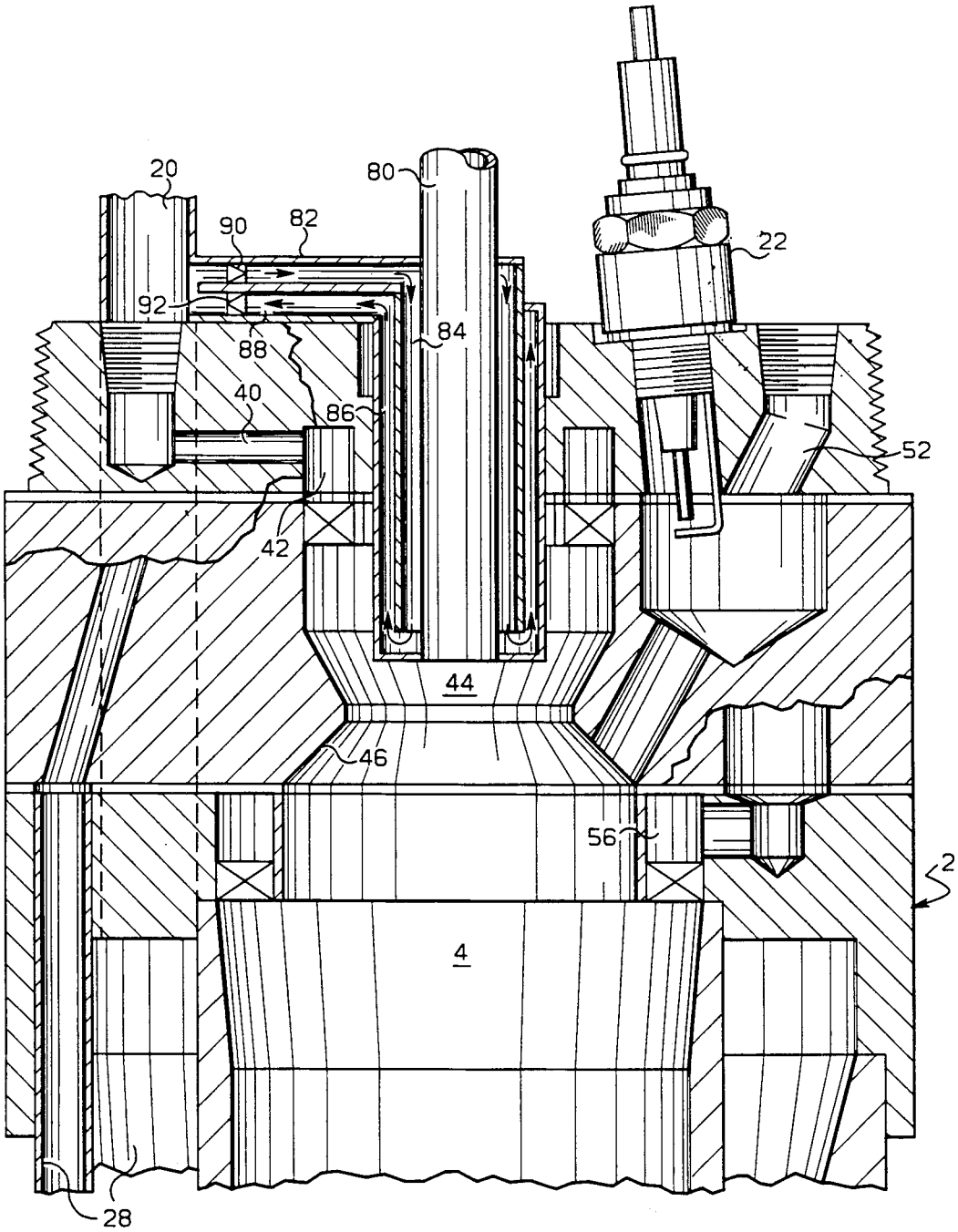
FIG. 7 is an elevational view, partially in section, of yet another embodiment of a combustor head for the combustor of the present invention.

FIG. 7 of the drawings sets forth an elevational view, partially in cross section, of yet another embodiment of a combustor head, in accordance with the present invention. Where appropriate, numbers which are duplicates of those appearing in FIG. 2 of the drawings are utilized to illustrate the same items in FIG. 7. The combustor head of FIG. 7 is adapted to burn solid, ashless fuels, such as solvent refined coal (SRC I) and asphaltene bottoms from oil extraction processes, etc. These fuels have melting points above about 250° F. and are, therefore solids at the temperature of introduction to the generator. Fuel would be pulverized to a suitable fineness and fed to the generator dispersed in a suitable carrier fluid, usually a portion of the air. The fuel is introduced to the combustor head by introduction means 80. In this case, introduction means 80 is simply a straight pipe. Since such solid fuels often become tacky as they approach their melting points, introduction means 80 is open without constrictions of any kind on the downstream end thereof. Also, because of the tendency of such fuels to become tacky and therefore stick to hot surfaces, causing fouling and eventual plugging, the tip of introduction means 80 is cooled to prevent build up of the solid fuel on the inner surfaces of the tip and the plugging thereof. Such cooling is conveniently carried out by taking a small side stream of water from water introduction conduit 20 and passing the same through conduit 82, thence through annular passage 84 surrounding introduction means 80 and returning the same through annular passage 86 and conduit 88 back to water conduit 20. Flow of the water through the cooling jacket can be appropriately controlled, as by means of one-way valves 90 and 92.

Figure 8:
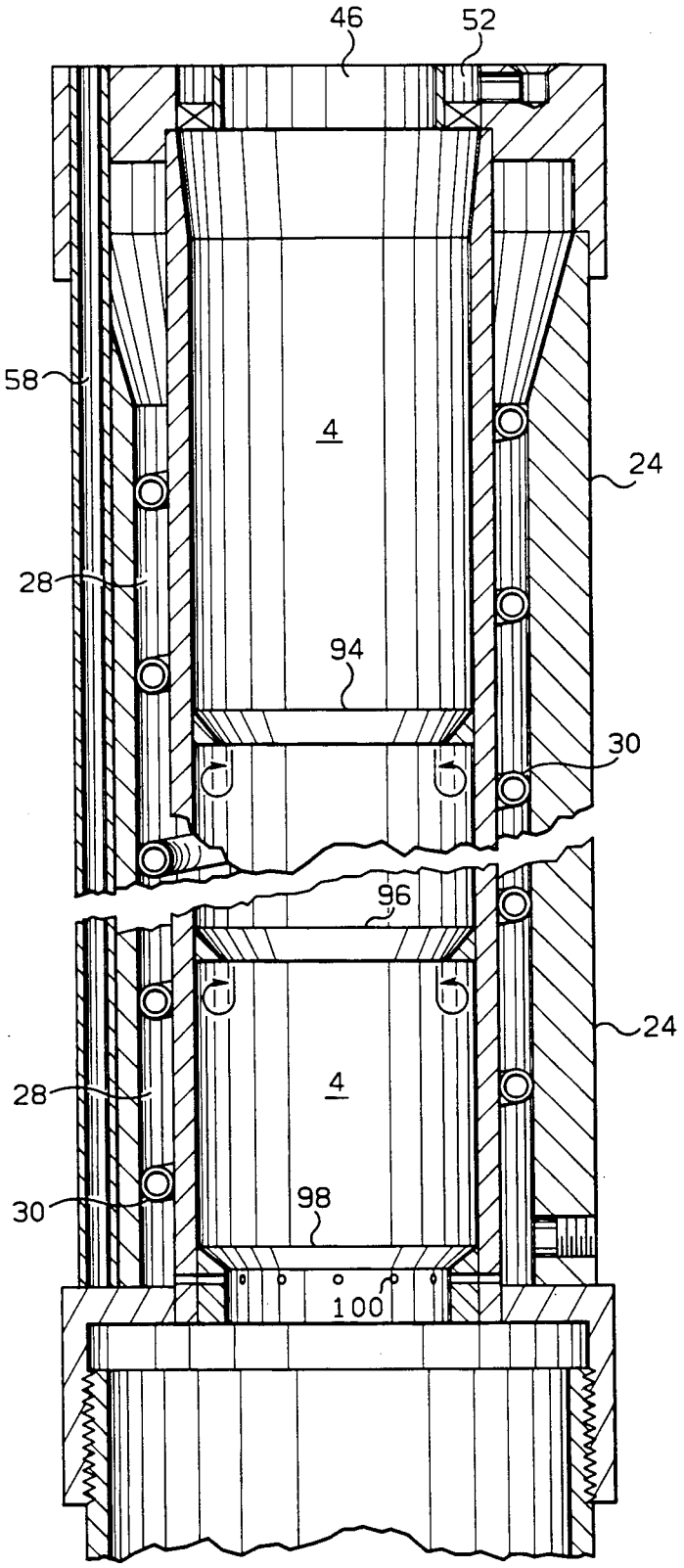
FIG. 8 is an elevational view, partially in cross section, of a modification of the combustion chamber of the combustor of the present invention.

Up to this point combustor heads adapted to operate on fuels ranging from gaseous-to-liquid-to solid have been described. Since complete combustion of a fuel requires an increased residence time the heavier or more difficult to burn the fuel becomes, gases normally require the lowest residence time, light liquids next, heavy liquids still higher and normally solid fuels the highest. Accordingly, since the diameter of the combustion chamber is limited by the diameter of the bore hole in which it is to be utilized, in order to increase the residence time it is necessary to increase the length of the combustion chamber. Several alternatives are available within the scope of the present invention. As previously indicated, the steam generator of the present invention is modular and combustion chambers of sufficient length to provide the necessary residence time for the fuel to be utilized can be substituted in the generator. Alternatively, a single combustion chamber having a sufficient length to provide adequate residence time for complete combustion of the heaviest fuel to be utilized, for example, crude oil or normally solid fuels can be utilized and the same combustion chamber utilized for all fuels contemplated. It is to be recognized, of course, in this case, that the combustion chamber would be longer than necessary for the lighter fuels. Yet another alternative in accordance with the present invention is shown in FIG. 8 of the drawings. FIG. 8 is an elevational view, partially in cross section, of a modified combustion chamber in accordance with the present invention. Where appropriate, duplicate numbers from FIG. 2 are utilized in FIG. 8 to designate duplicate items.

In accordance with FIG. 8, a shorter combustion chamber and/or the same length combustion chamber for heavier fuels can be utilized by placing at least one diametric restriction in the combustion chamber. Specifically, in FIG. 8, restrictions 94 and 96, respectively, are mounted in the combustion zone. Restriction means 94 and 96 may be simple orifice plates adapted to reduce the diameter of the combustion chamber and thereafter abruptly expand the fluids into the portion of the combustion chamber downstream of the orifice. As indicated, the restriction means 94 and 96 can be conventional flat orifice plates. However, as shown in FIG. 8, the restriction means 94 and are tapered at their upstream ends in order to eliminate sharp corners where deposits can collect. As shown by the arrows, the abrupt expansion of the fluids at the downstream side of orifice means 94 tends to move the fluids toward the wall of the combustion chamber, thus mixing the core of fluids with more of the rotating air blanket along the walls of the combustion chamber. This promotes more complete utilization of the air and more complete combustion. This rotational motion toward the walls thence back toward the center of the flame also serves to cool the downstream side of the orifice means thus preventing deposit formation thereon and further serves to prevent excessive backflow from the downstream side of the orifice to the upstream side. While the size of the orifice will vary, depending upon the degree of mixing with the air film on the walls of the combustion chamber and the nature of the fuel, the size can be readily optimized experimentally to minimize pressure drop while achieving complete combustion. For example, however, where a No. 2 fuel oil is to be burned, an orifice creating a 30% reduction in open area could be, utilized and the orifice 94 mounted about half way down the combustion zone. The second orifice 96 would have the same diameter and would preferably be mounted approximately one combustor diameter upstream of the water injection aperatures 32. Orifice 96 serves essentially the same purposes as orifice 94 and accomplishes the same results. In addition, it reduces the tendency for the water to back flow into the combustion zone thereby cooling the combustion front and obviously reducing the degree of combustion and in effect, shortening the combustion zone. Orifice 96 may, in some cases, be unnecessary and orifice 94 would suffice. Also, water apertures 100 can be formed in the vena contracta of a nozzle type orifice 98 rather than or in addition to employing orifice 96.

Figure 9:
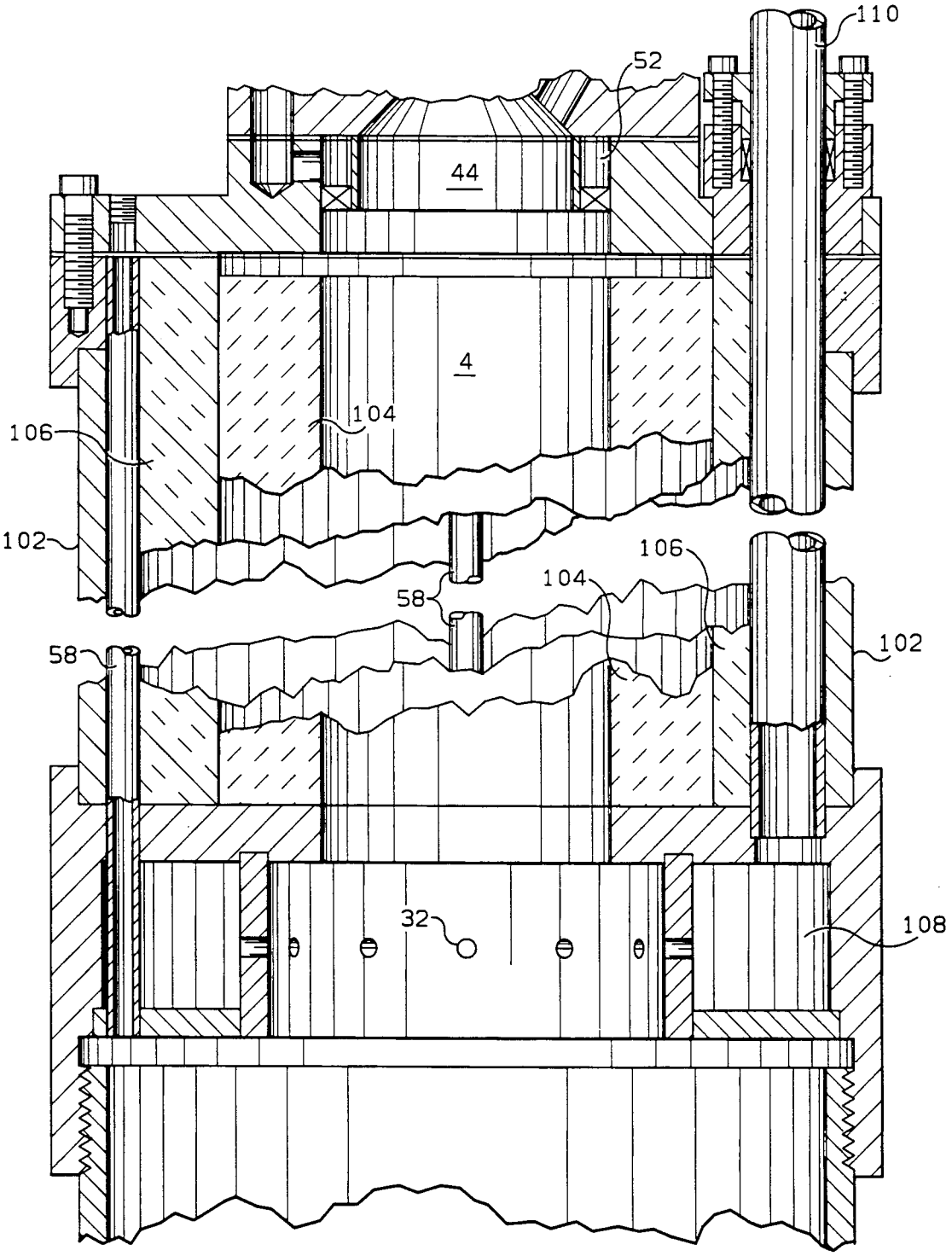
FIG. 9 is an elevational view, partially in section, of yet another modification of the combusting chamber of a combustor in accordance with the present invention.

As previously indicated, utilization of the steam generator in the well bore causes numerous difficulties in providing an effective and workable generator. The steam generators discussed up to this point are utilizable in wells having a 7-inch internal diameter casing. This is an extremely severe limitation which creates innumerable problems not encountered in generators utilizible only at the surface of the earth. For example, the maximum external dimension must be about six inches. As a result, the combustion chamber must be made of metal and it is necessary to water cool the combustion chamber in order to prevent internal burning and the formation of deposits on the interior of the combustion chamber. However, many wells of recent vintage, particularly deep wells, have been drilled to accept a 13-inch internal diameter casing. Consequently, a steam generator for use in such wells can have a maximum external diameter of 12 inches. FIG. 9 of the drawings is an elevational view, partially in cross section, of another modification of a combustion chamber in accordance with the present invention which can be utilized in a well having a 13-inch casing. Corresponding numbers utilized in FIG. 2 of the drawings have been utilized in FIG. 9 to designate corresponding parts.

In accordance with FIG. 9, the combustion chamber 4 comprises an outer metal casing 102, an internal ceramic lining 104 and an insulating blanket 106 wrapped around the ceramic liner between the ceramic liner and the metal casing. The ceramic liner alleviates burning of the interior of the combustion chamber or burner deposit problems encountered when utilizing a metallic combustion chamber. The insulating blanket protects the metal outer wall from excessive heating. In addition, adequate ceramic lining and insulation can be incorporated in the combustion chamber of the steam generator while still increasing the internal diameter of the combustion chamber to 4 inches from the 3-inch internal diameter dictated for a generator utilizable in a 7-inch casing. The means for introducing the steam generating water is also greatly simplified since the water can be introduced through a simple conduit 110 mounted in the insulation, which in turn discharges into an annular chamber 108. Similarly, the channels 58, for the passage of thermocouples therethrough to the vaporization chamber, can also be mounted in the insulated annular space. Finally, the 4-inch internal diameter combustion chamber also increases the heat release of the steam generator and/or shortens the combustion chamber. For example, from about 7MM Btu/hr to about 12 MM Btu/hr, in one specific case.

The ultimate objective in the design and operation of any steam generator is to force steam at least a short distance into the producing formation surrounding the borehole so that it will contact the oil therein, heat the oil and reduce the oil viscosity to aid in production. In order to accomplish this, the output pressure of the generator must exceed the outside pressure by a significant amount. Accordingly, the design and operation of the generator is such that the unit will have a predetermined fluid (steam and exhaust gas) output pressure, taking into consideration pressure drops or losses in the unit itself. This output pressure of course depends upon the velocities of the flue gases from the combustion chamber and the flue gas-steam mixture from the vaporization cahmber. Concommittently, the generator is also, desirably, operated efficiently, namely to obtain essentially complete combustion of the fuel in the combustion chamber and essentially complete vaporization of the water in the vaporization chamber.

Figure 10:
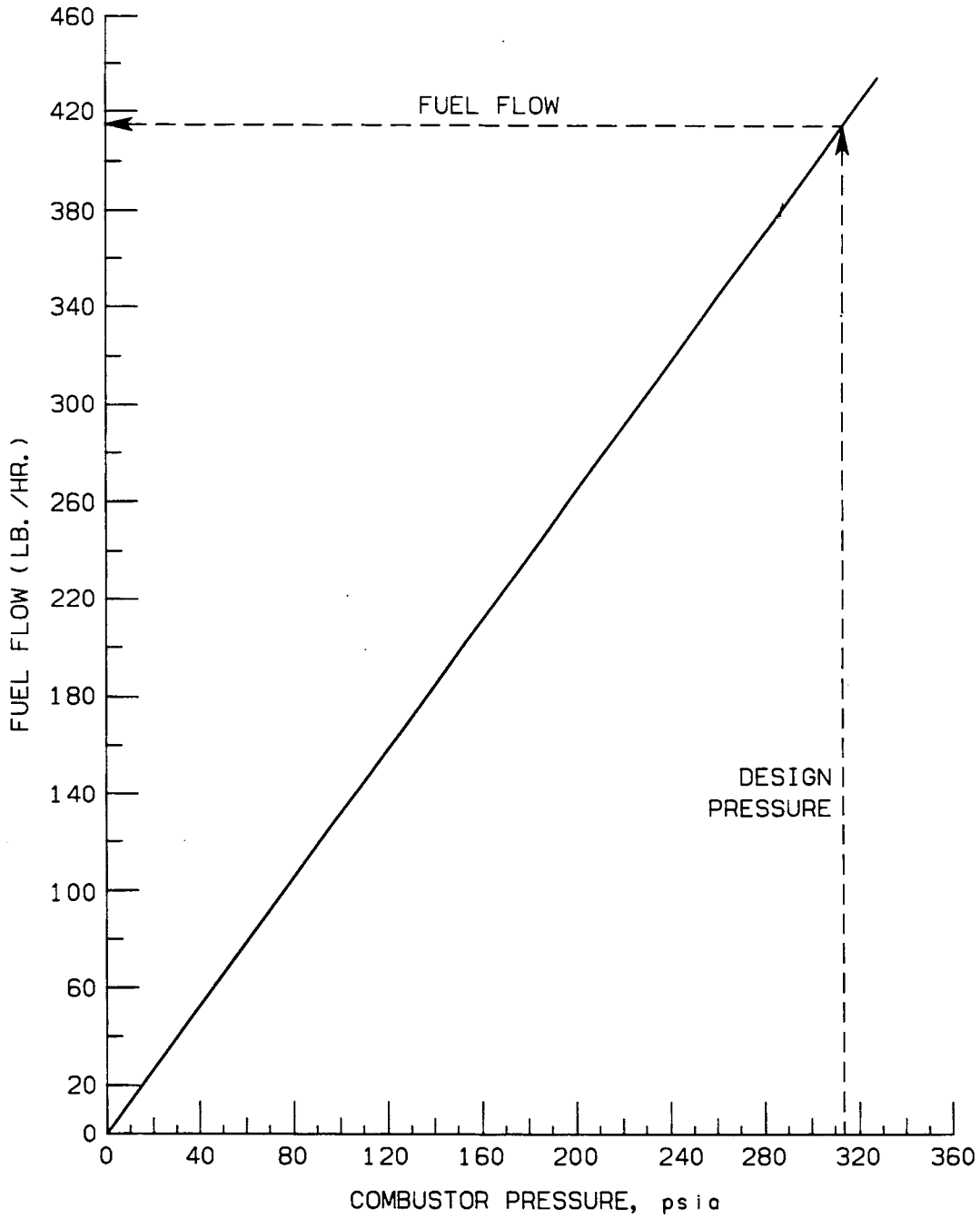
FIGS. 10, 11 and 12 are plots of fuel flow, air flow and water flow, respectively, versus combustor pressure for a combustor in accordance with the present invention.
Figure 11:
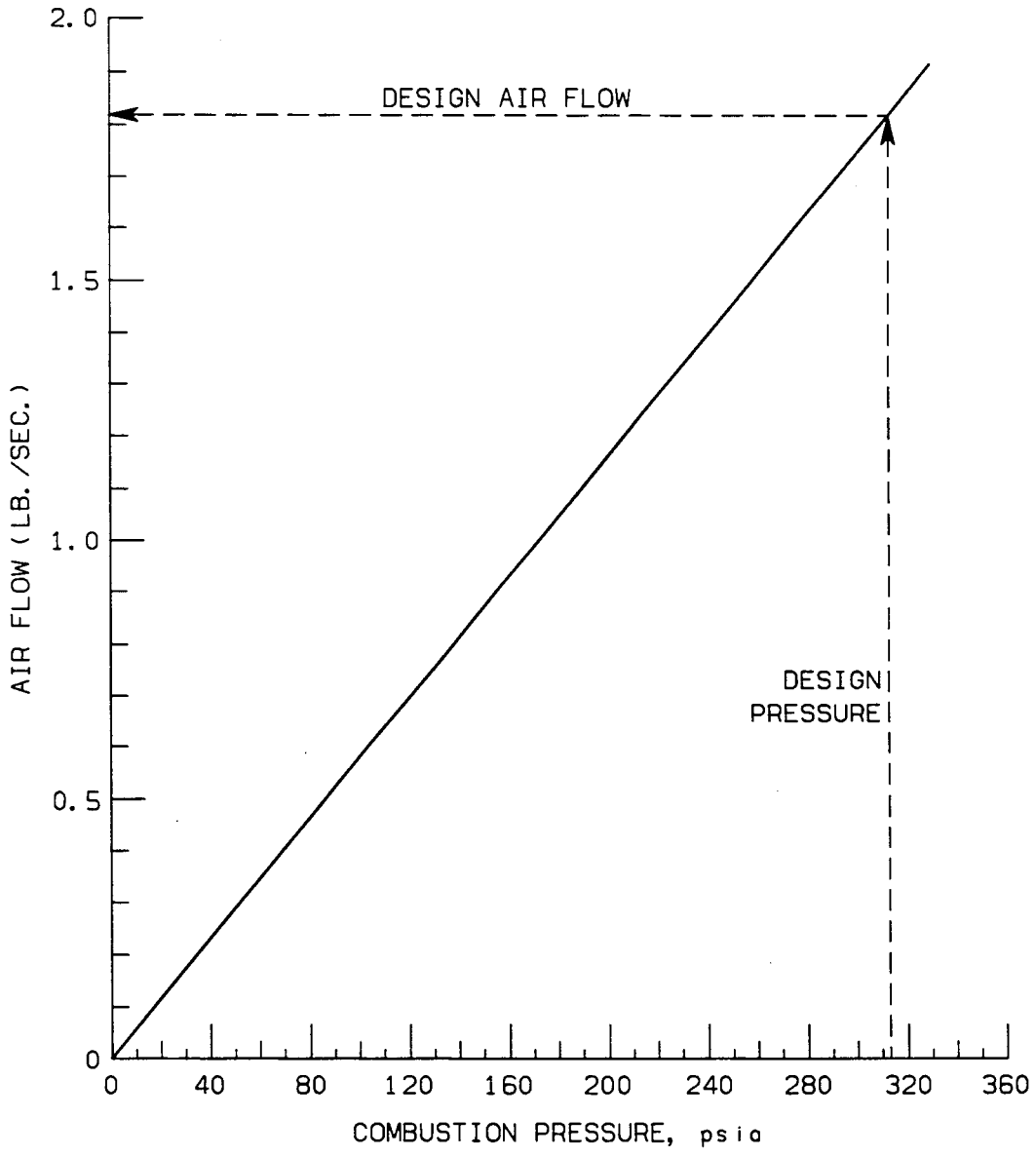
Figure 12:
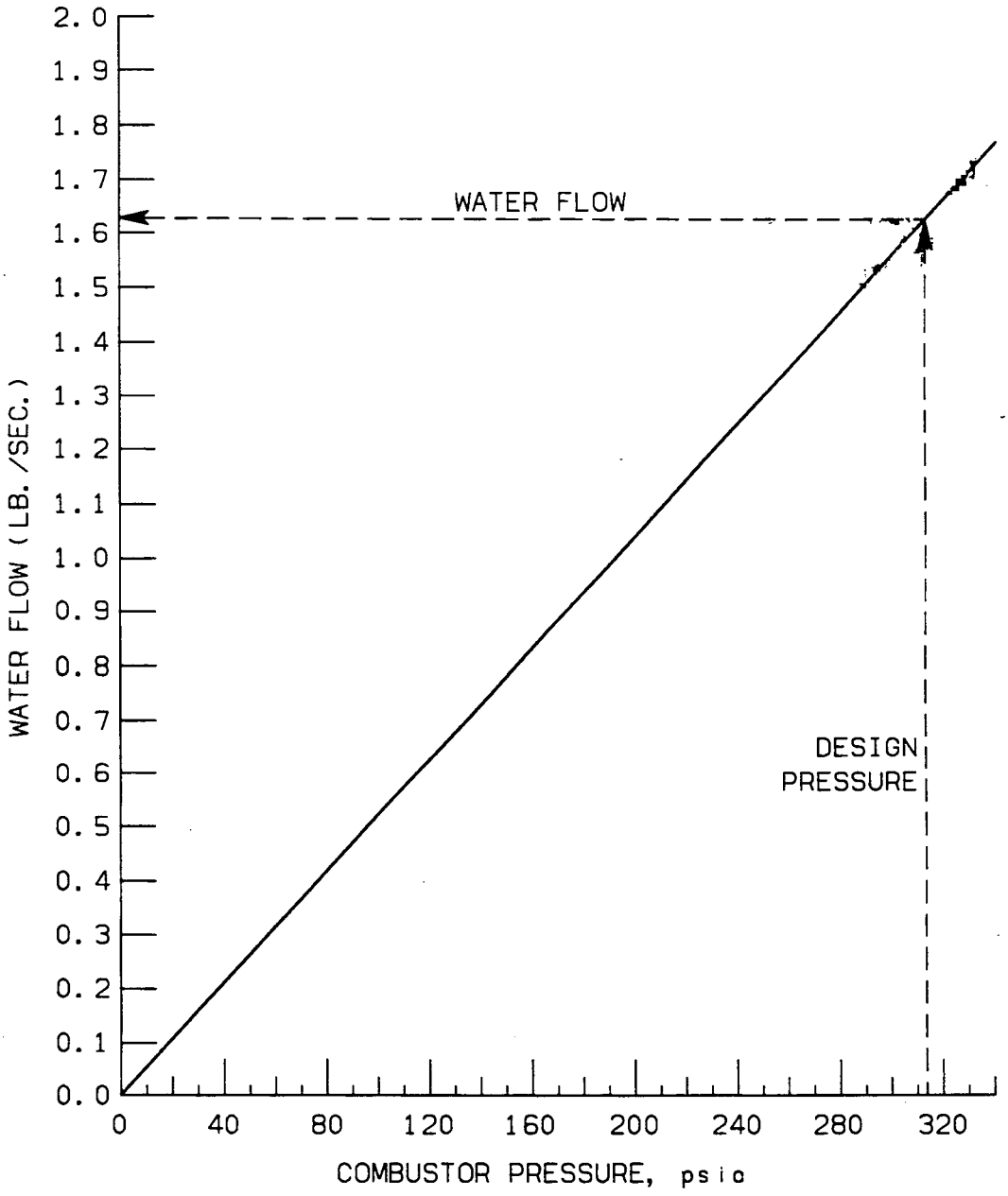

To attain such efficient operation, the design and operation of the unit should be at the design combustion chamber flow velocity and the design vaporization chamber flow velocity, which in turn produce the design output pressure of the unit. If the combustion chamber is operated at the design flow velocity, sufficient residence time in the combustion chamber is provided to vaporize and/or, assuming, of course, that the fuel/air ratio is maintained for stoichiometric operation, for example 3% excess $O_2$ on a dry basis, burn a given fuel. Operation at a higher combustion chamber flow velocity results in incomplete combustion, accompanied by excessive deposits in the burner, excessive carbon particles in the output fluids and possible formation plugging and possible flame out. Operation at a lower combustion chamber flow velocity results in a reduced heat output below the design heat output of the burner. Similarly, if the vaporization chamber is operated at the design flow velocity, sufficient residence time is provided in the vaporization chamber to essentially completely vaporize the water. On the other hand, operation of the vaporization chamber at a higher flow velocity reduces water evaporation efficiency and uniformity of the temperature distribution at the outlet, and operation of the steam generator at a lower velocity reduces steam generation below the design steam output. The design flow velocities in the combustion chamber and the vaporization chamber (and in turn the design output pressure) are, in turn, determined by the fuel and air flow rates and the water flow rate, respectively. This is illustrated by FIGS. 10, 11 and 12, which are plots of fuel flow rate vs. output pressure, air flow rate vs. output pressure and water flow rate vs. output pressure, respectively. By way of example, a design output pressure of 314.7 is shown. Unfortunately, it is not always possible to achieve the design operating pressure. Characteristically, this would be the case during start-up. It could also result from an inability to build-up the downhole pressure to that level. In such cases, in accordance with the present invention, the unit can be operated with reduced fuel flow, reduced air flow and reduced water flow, at the attainable output pressure, as determined from plots, such as FIGS. 10, 11 and 12, respectively. Such operation thus prevents inefficient operation and unnecessary derating even though design heat output and design steam generation are at least temporarily sacrificed.

Operation at or near the design output pressure, as discussed above, assumes that there are no outside forces acting on the generator. This is not the case in downhole operations. In downhole operations, the formation fluid pressure creates a backpressure in the generator, thus reducing the output pressure, and the formation fluid pressure changes during operation, for example, the formation fluid pressure (back pressure) increases as the volume of fluids forced into the formation increase and in some cases decreases as formation fluid is produced. These variations can be taken into consideration to some extent in the design and operation of the unit to thus maintain a unit output pressure great enough to produce fluid flow into the formation. However, there are no easy answers to the problem. In accordance with the present invention, several alternative techniques for overcoming this problem are set forth below.

Figure 13:
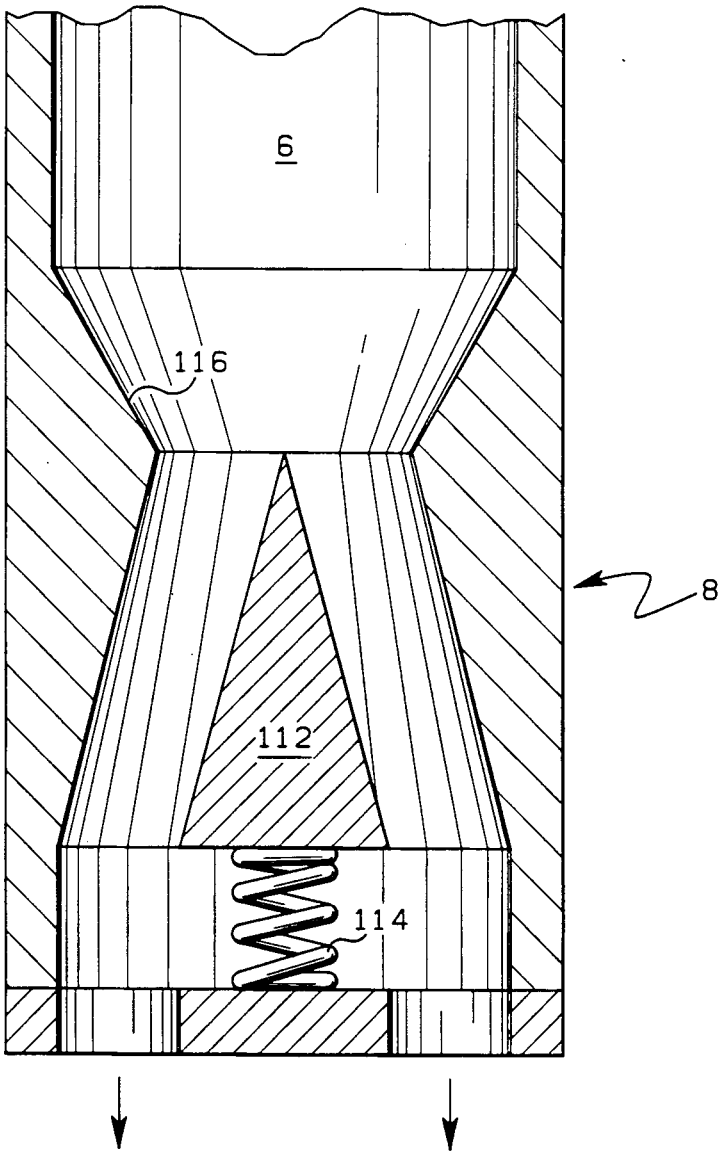
FIGS. 13, 14, 15 and 16 are elevational view, partially in cross section, showing embodiments of discharge means for steam generators in accordance with the present invention.
Figure 14:
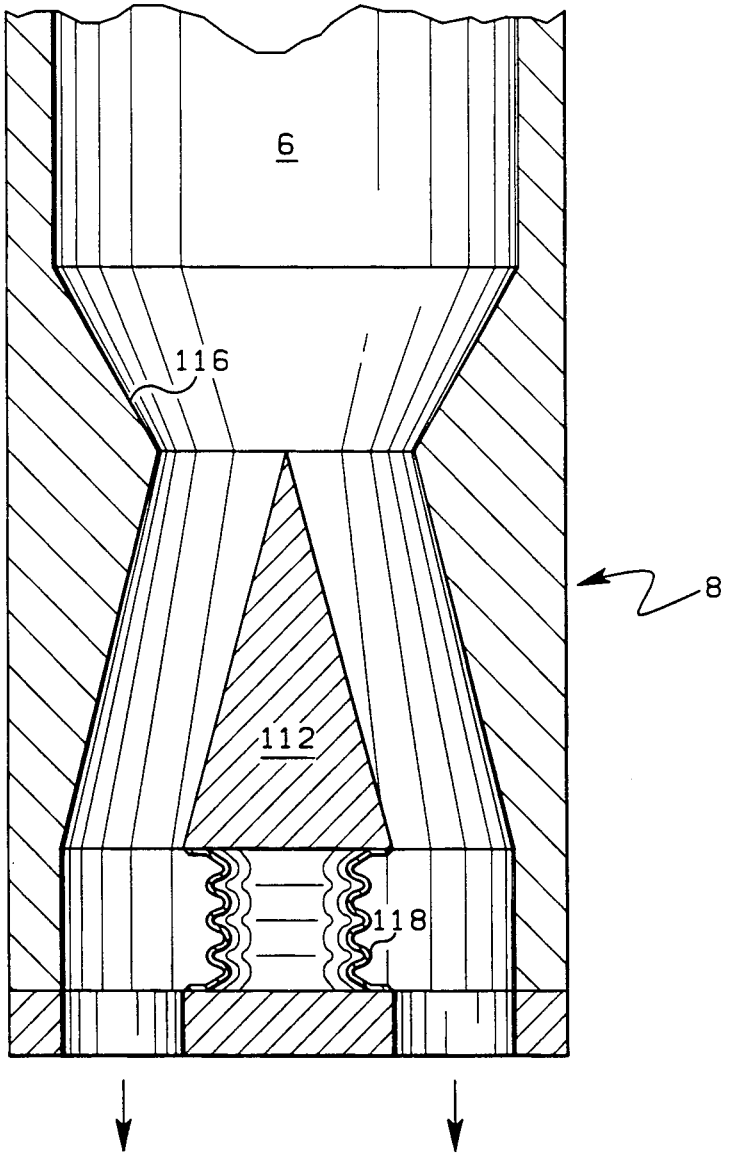
Figure 15:
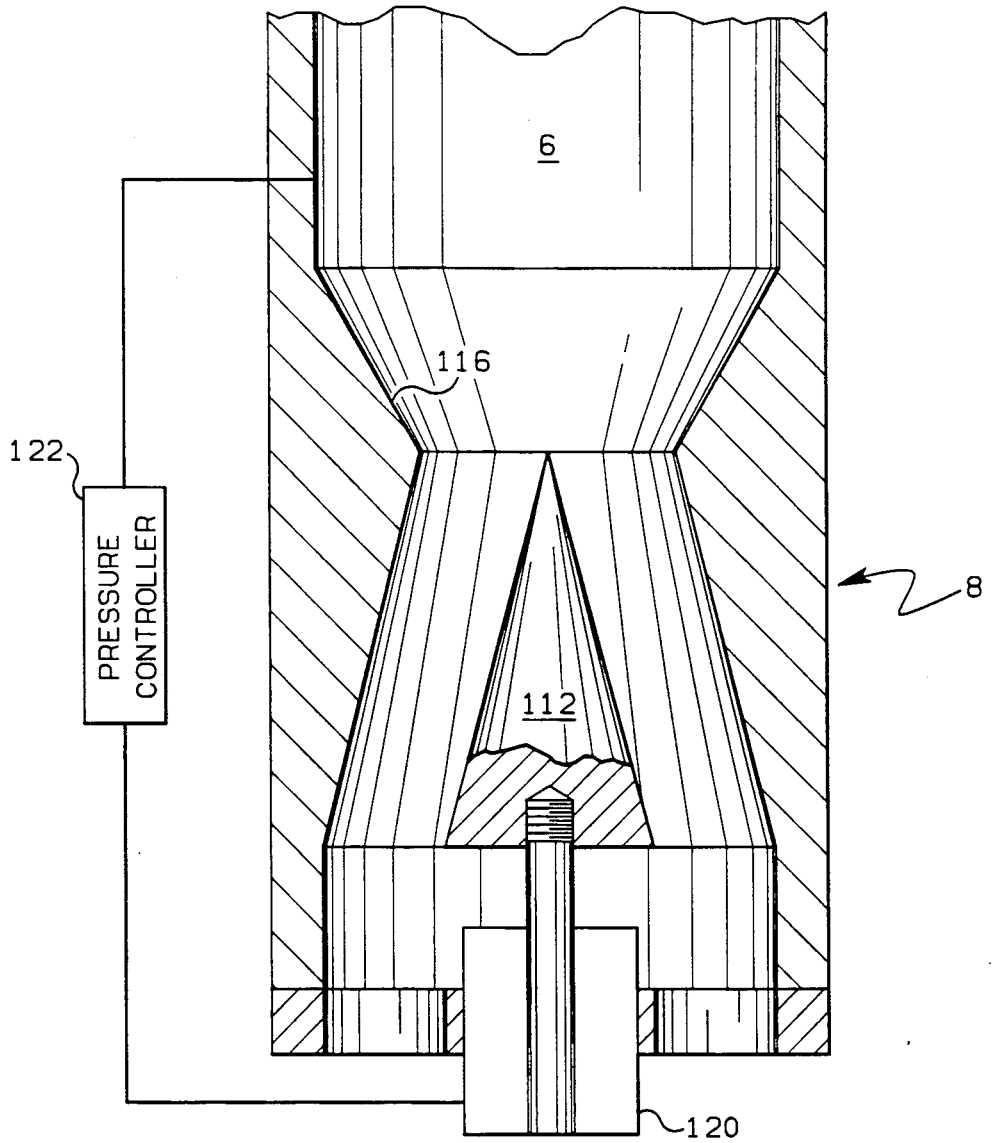

As previously indicated, air and fuel flow, and consequently, the air-fuel ratio, can be controlled to maintain proper stoichiometry for clean combustion. This, of course, can be accomplished at the surface of the earth when the generator is used as a downhole generator. However, even with control over the stoichiometry and adjustment of air and fuel flow rates to maintain the design point residence time in the combustor, the performance of the combustor would vary prohibitively because of the back pressure created by formation fluids and, particularly, because of pressure build-up in the formation. Consequently, the design outlet pressure would be impossible to maintain. For example, if the outlet pressure were 100 psig, the heat release would be 2.16 Btu/hr, at 240 psig, it would be 6.09 Btu/hr, at 300 psig (close to the design point previously discussed), the heat release would be 7.16 Btu/hr and at 450 psig, the heat release would be 10.57 Btu/hr. Consequently, in order to eliminate this problem, it is necessary to control the pressure in the generator to at all times maintain the pressure at or near the design point pressure. This is accomplished in accordance with the present invention by variations of the outlet nozzle 8 of the generator. Specifically, FIGS. 13, 14 and 15 schematically illustrate three modified nozzles which can be utilized to accomplish this. The nozzles of 13, 14 and 15 are designed to automatically maintain the pressure in the generator at or near the design point pressure. In FIG. 13, a movable plug 112 is mounted in the diverging section of the nozzle and is actuated by a spring 114. Accordingly, as the external pressure varies, the plug 112 will move inwardly and outwardly, thus varying the open area through the vena contracta 116 of the nozzle and thereby automatically maintaining the pressure within the generator at or near the design point pressure. While the apparatus of FIG. 13 is relatively simple, it is not particularly accurate. FIG. 14 illustrates another embodiment in which the movable plug 112 is attached to a pneumatic bellows 118. The pneumatic control would add an additional force to the positioning of the plug 112, i.e., the pressure generated in the bellows would be acting against the pressure outside of the bellows, as well as the flow momentum from the generator. This control can be operated in a similar fashion to that FIG. 13 but would be more accurate. FIG. 15 of the drawings illustrates an even more accurate control means wherein plug 112 is moved by a positioner 120, for example, a conventional diaphragm control or electric motor control. The positioner 120 is, in turn, automatically controlled by sensing the pressure in the generator by means of a pressure sensor (not shown) and transmitting the thus sensed pressure to an appropriate pressure controller 122, which in turn, operates positioner 120.

Figure 16:
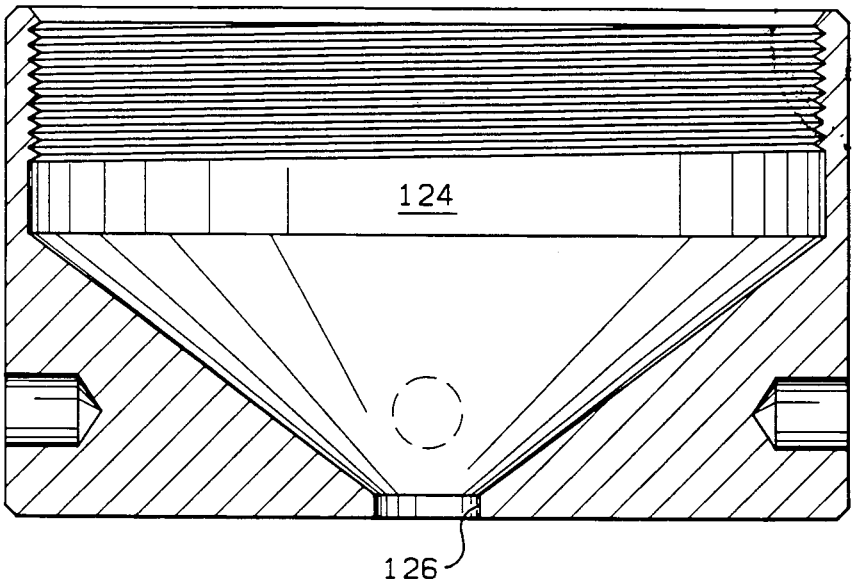
Figure 17:
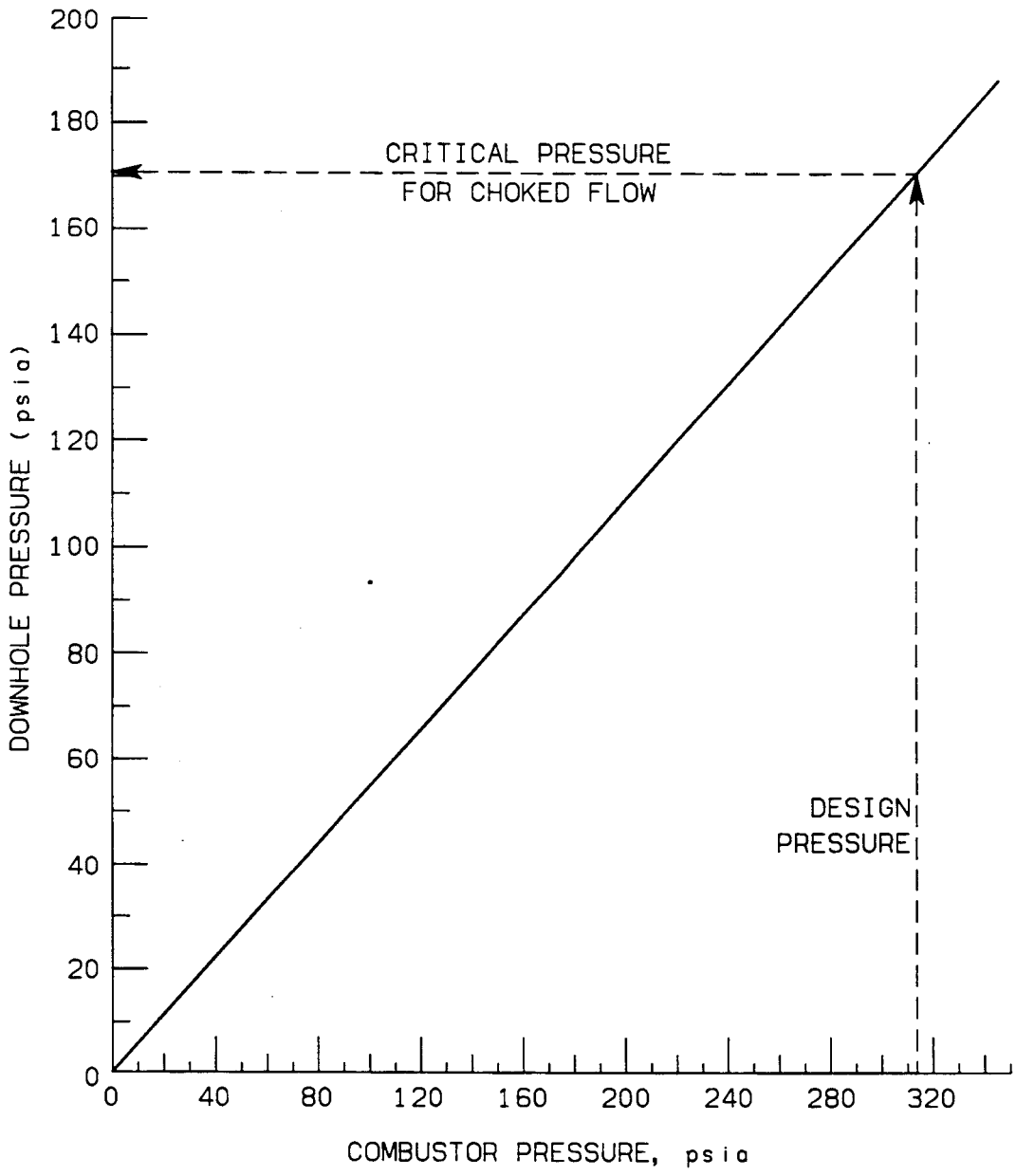
FIG. 17 is a plot of downhole pressure versus combustion pressure for a steam generator of the present invention when operated at choke flow.

In yet another embodiment of the present invention, the nozzle 8 is replaced by a nozzle, such as that illustrated in FIG. 16, wherein nozzle 124 has an outlet 126 sized for operation with choked flow. It is known that when the acoustic velocity prevails at the nozzle throat 126, a further decrease in the back pressure does not change the flow, but the flow remains fixed at the maximum value. Accordingly, there is a specific throat diameter and a critical expansion ratio through the nozzle, for a constant area burner, which will result in choking of the flow. This limits the inlet flow rate to the burner and thereby prevents the liberation of more energy from the burner, even if the outlet pressure is lowered for increased momentum effects. This is illustrated by the plot of FIG. 17 wherein the down hole pressure is plotted against the combustor pressure. Critical pressure for choked flow at the previously mentioned design pressure of 314.7 psia is also indicated on FIG. 17. It is to be noted that the down hole pressure required to maintain choked flow decreases with decreasing combustion pressure, as shown in FIG. 17. This technique, of course, greatly simplifies the maintenance of flow velocities at or near design conditions. It is also possible to make the diameter of throat 126 variable so that the burner can be operated with choked flow at different combustor pressures, as is evident from FIG. 17, or provide a variety of nozzles with different fixed throat diameters which may be readily substituted in the generator.

Figure 18:
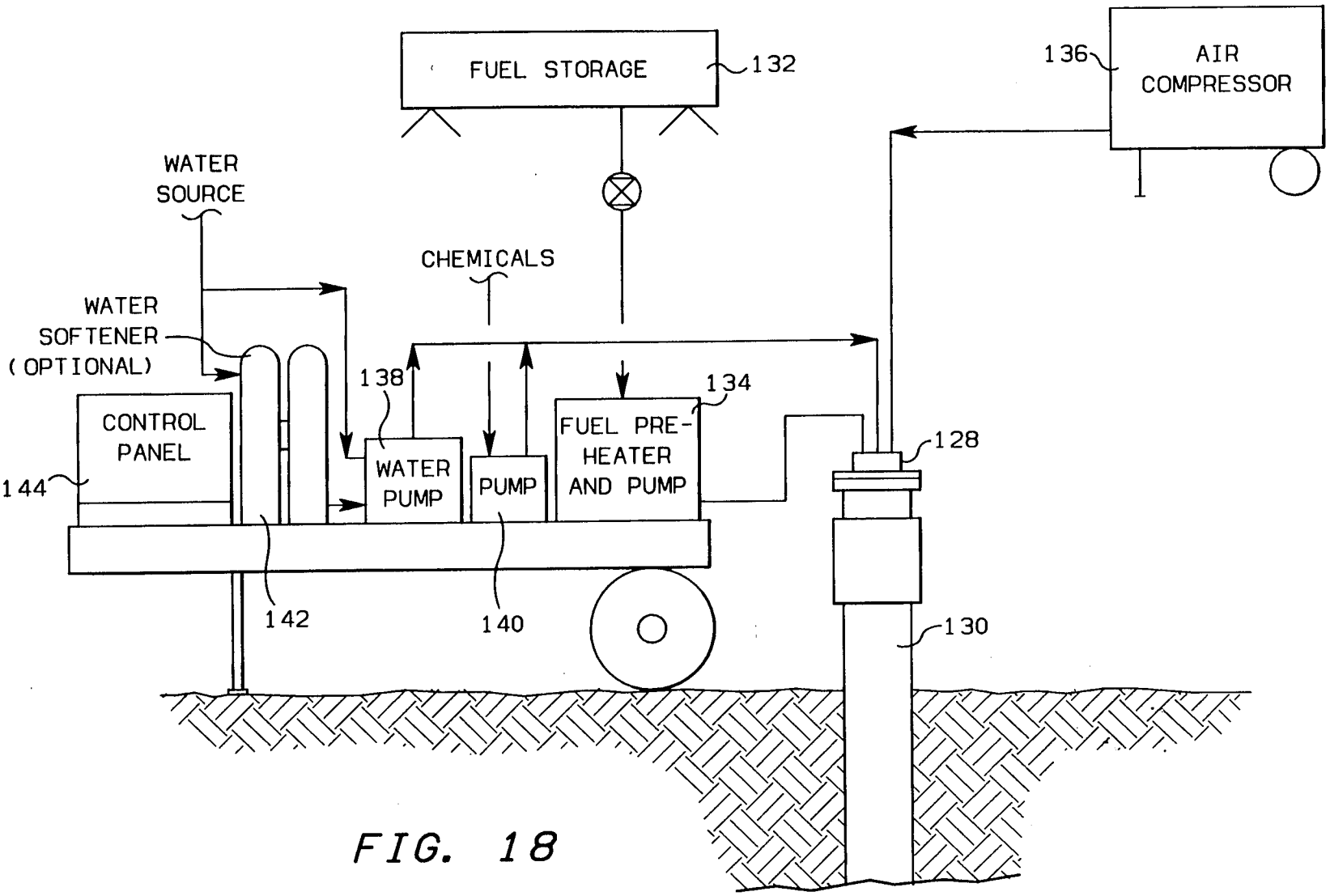
FIG. 18 is a schematic flow diagram showing a steam generator in accordance with the present invention mounted in well casing, together with support equipment for supplying fuel, water and air to the steam generator.

FIG. 18 is a schematic representation of the steam generator of the present invention mounted in a wellhead at the surface of the earth. In accordance with FIG. 18, the steam generator 128 is mounted in well casing 130 with only the combustor head exposed. Fuel is supplied from a storage vessel 132, or other source, to a fuel preheater and pumps 134. Obviously, where preheating of the fuel is unnecessary, the preheater would not be needed. Also, if the fuel is, for example, a gas the pumps would be replaced by a compressor and the compressor could be eliminated if the gas were already under pressure. Air is supplied by a suitable compressor 136. Water, for steam, is supplied through pump 138. In order to reduce corrosion, for example by the addition of a pH adjuster and an oxygen inhibitor, or for other treatments, chemicals would be added to the water by pump 140. Optionally, the water can also be treated in water softener 142. A control panel 144 is connected to suitable sensing and measuring means to monitor the operation and also can carry remote control means for controlling the various parameters.

Obviously, in the arrangement of FIG. 18 or when the steam generator is used outside a well or down a well adjacent the formation to be treated, the support equipment, such as the fuel preheater and pump, the water treaters and pumps and the air compressor, may comprise single units serving a plurality of steam generators at a plurality of injection wells. This would further reduce the cost of operation, particularly when utilizing a single central air compressor.

The following specific example sets forth the basic design of a steam generator which was built, in accordance with the present invention, to burn a fuel oil (ASTM D396 No. 6).

Basically, the steam generator comprised a modular unit having the following modules detachably coupled in series. A combustor head having a centrally mounted, air-blast atomizer adapted to produce fuel droplets of 70 μm Sauter mean diameter (SMD), or less; air introduction means to the combustor comprising concentric, counter rotating, annular swirlers to create an axial, toroidal vortex to serve as a flame holder, and to provide a strong shear surface between counter rotating air streams to prevent fuel penetration to the wall of the combustor; a combustor chamber of standard 3-inch diameter pipe, which is cooled by the water to be eventually injected into the hot flue gas at the outlet end of the combustion chamber; and means for the radial injection of water into the flue gas from the cooling jacket comprising twelve uniformly spaced holes, 0.0625 inches in diameter, the holes are placed at the outlet end of the combustor; a vaporizer chamber of standard 5-inch diameter pipe; and an exhaust nozzle to maintain pressure in the unit.

The atomizer selected was a Delavan swirl-air combustion nozzle (Delavan Mfg. Co., West Des Moines, Ia.) since such an air blast atomizer offers significant advantages in achieving a fine, uniform spray of a broad range of fuels from distillates to heavy crude oils. The nozzle also is small in size (1" diameter and 2.6" long) making it well suited for the steam generator. The rated fuel flow was 50 gal/hr. which produced a power output of 7.59 MM Btu/hr. when operating with a typical No. 6 fuel oil. The following Table 1 illustrates typical values for the atomizer:

TABLE 1

Fuel Atomizer

Fuel Flow Rate = 50 gal/h
Calorific Value = 18,330 Btu/lb
Power Output = 7.59 MMBtu/h
Fuel Viscosity = 3 cS @ 350° F.
Droplet Size = 70 μm Sauter Mean Diameter Evaporation Time=7 ms @ 300 psi and 900° F.

The combustor chamber was designed to operate with an overall stoichiometry of 3% excess oxygen, on a dry basis, to achieve complete and clean burning. Plug flow velocity, at flame temperature, will be maintained at about 177 ft. per second. Consequently, the length of the combustor section required for vaporization of the fuel in question was 15 inches. Characteristic residence time of gases in a combustor of this type is 10 milliseconds. Since light distillates were to be burned, the rate controlling step was based upon chemical reaction kinetics. Using this value, the length required for combustion of the vaporized heavy fuel oil was 21 inches. Therefore, to accomplish both fuel vaporization and combustion, a combustion chamber length of 36 inches was provided. Based on the established power output and the combustor volume, the resulting heat release rate for the combustor was 49 MM Btu/hr·ft$^3$. Normalizing for pressure, this is a heat release rate of 2.3 MM Btu/hr·ft$^3$. atm. The following Table 2 presents the operating characteristics of the combustion chamber.

TABLE 2

Combustor

Oxygen in Exhaust Gas=3.00 volume % (Dry)
Fuel/Air Ratio=0.0635 lb/lb
Air Flow Rate=1.81 lb/s
Combustor Pressure=300 psi
Inlet-Air Temperature=800° F.
Flame Tube=3 in Pipe
Flow Velocity=177 ft/s @ 3800° F.
Length for Vaporization=15 in
Combustion time=10 ms
Length for Combustion=21 in
Combustor Length=36 in
Heat Release Rate=49 MMBtu/hr·ft$^3$ In the design of the vaporizer chamber, a flue gas steam outlet temperature of 500° F. was selected, which is 78° F. superheat. This required a water flow rate of 706 gal/hr. Other exhaust gas temperatures and steam qualities can be obtained by simply adjusting the water flow rate. Assuming plug flow in the vaporizer chamber, the average velocity was about 107 ft. per second. With the water atomized to approximately 300 μm SMD and in the environment anticipated, it was estimated that a water droplet will evaporate in 20 ms. Using these values, the length required for the complete vaporization of the water was 26 inches.

TABLE 3

Vaporizer

Exhaust-Gas Temperature=500° F.
Steam Quality=78° Superheat
Water Flow Rate=706 gal/h
Vaporizer Tube=5 in Pipe
Flow Velocity=107 ft/s
Droplet Size=300 μm Sauter Mean Diameter
Evaporation Time=20 ms @ 300 psi and 500° F.
Vaporizer Length=26 in Accordingly, the overall length of the steam generator was about 6 feet with a maximum diameter of 6 inches, which of course, is small enough to be lowered into a well through a 7-inch casing. Based on the operating and design variables for the steam generator, the effluent can generally be described as follows. The volume of flue gas plus steam is about 5.1 ft$^3$/sec. at 300 psi and 500° F. In a 7-inch diameter casing, the flow velocity is 19 ft./sec. The composition of the effluent is primarily steam (62%) and nitrogen (32%), with some carbon dioxide (5%) and oxygen (1%), and trace quantities of sulfur dioxide and nitrogen oxides. This composition would not be altered significantly by operation of the steam generator on other hydrocarbon type fuels. Most importantly, the amount of acid forming gases ($SO_x$ and $NO_x$) from the sulfur and nitrogen in the fuel must be neutralized to prevent excessive corrosion of the well. The characteristics of the mixture of flue gas and steam from the steam generator is summarized in the following Table 4:

TABLE 4

| EXHAUST GAS | |
|---|---|
| volume = | 5.1 ft.$^3$/s @ 300 psi & 500° F. |
| Well caseing = | 7 in. Pipe |
| Flow Velocity = | 19 ft/s |
| Composition | |
| Water = | 61.78 volume % |
| Nitrogen = | 31.70 |
| Carbon Dioxide = | 5.31 |
| Oxygen = | 1.15 |
| Sulfur Dioxide = | 0.04 (1.93 wt % S in Fuel) |
| Nitrogen Oxides = | 0.02 (0.28 wt % N in Fuel) |
| | 100.00 |

A steam generator constructed as previously described, was utilized in two field tests in the Kern River Field Reservoir, California. This field contains unconsolidated oil sands ranging in thickness from 25 to 125 ft., has permeabilities 1 to 5 darcies and porosities of 28% to 33%. Reservoir pressure averages about 100 psig. The oil gravity is generally 12° to 14° API with a viscosity ranging from 4,000 cp at reservoir temperatures.

In the first of the field tests, the steam generator was located at the surface of the earth about 15 ft. from the wellhead. A total of 537 barrels of steam was injected in a cyclic test ("huff and puff") at a rate of 150 barrels per day, a pressure of 225 psi, a temperature of 405° F. and at a steam quality of 90% to 95%. In this test, the 15-day oil/steam ratio was 0.307 and the peak production was 22 barrels of oil per day. This, compared with a prior conventional injection of steam from a surface generator in which the 30-day oil/steam ratio was 0.047 and the peak production was 12 barrels of oil per day. In the second test, a total of 1,393 barrels of steam was injected, in a manner similar to the previous test, at a rate of 275 barrels per day, a pressure of 425 psi, a temperature of 420° F. and a steam quality of 85%. As a result of this test, the 30-day oil/steam ratio was 0.237 and a peak production was 23 barrels of oil per day. This compared with a 2-cycle prior stimulation utilizing steam from a conventional surface boiler which resulted in a 30-day oil/steam ratio of 0.030 and a peak production of 10 barrels of oil per day.

It is obvious from the above results that the production efficiency and the rate of production are substantially improved by the use of the steam generator of the present invention as compared with conventional surface steam boilers now in use for the recovery of heavy oil. In fact, the literature and additional tests have indicated that increased production, as a result of the use of the steam generator of the present invention as compared with conventional surface boilers, has resulted in production increases of anywhere from 100% to 900% and the rate of production can be about double the rate in a conventional operation. Further, in the second of the above tests, several attempts were made to return the well to production after a normal two or three day "soaking". The well was then shut in for eleven days before it could be put on production by pumping and, despite the excessive soaking, the well showed a much stronger response to cyclic stimulation when utilizing the steam generator of the present invention, as compared with conventional surface steam injection systems.

Finally, even though in test No. 1, the flue gas contained 0.028% by volume of sulfur dioxide, which was injected at a rate of 0.105 standard cu. ft. per minute and for a cumulative total of 358 standard cu. ft. and in test No. 2, sulfur dioxide was 0.028 volume percent, injected at a rate of 0.202 standard cu. ft. per minute for a cumulative total of 3,730 standard cu. ft. testing of the produced fluid and casing gases from the well showed no sulfur dioxide in the produced gas and a small amount of the total sulfur injected was dissolved in the produced water. Hence, air pollution, as a result of the use of the steam generator of the present invention, can be virtually eliminated or at least significantly reduced.

While specific materials, specific items of equipment and specific conditions of operation and the like have been set forth herein, it is to be understood that such specifics are by way of illustration only and the present invention is not to be limited in accordance with such recitals.

What is claimed:

1. A method of generating steam comprising:

(a) introducing a fuel and at least a first volume of a combustion supporting gas into a mixing chamber having its downstream end in open communication with an elongated combustion chamber;

(b) creating a first toroidal vortex of said fuel and at least said first volume of said combustion supporting gas, in a volume at least equal to the stoichiometric volume necessary for combustion of all said fuel, said first vortex having its center adjacent the center of said elongated combustion chamber and rotating in one of a clockwise or counterclockwise direction to produce a body of said fuel and said combustion supporting gas moving from the inlet end of said combustion chamber toward the outlet end of said combustion chamber;

(c) creating a second toroidal vortex of a second volume of combustion supporting gas between said first toroidal vortex and the inner wall of said combustion chamber and rotating in the other of the clockwise or counterclockwise direction to produce an annular body of said second volume of combustion supporting gas moving from the inlet end of said combustion chamber toward the outlet end of said combustion chamber;

(d) burning said fuel in the presence of said combustion supporting gas to produce a flame moving from said inlet end of said combustion chamber toward said outlet end of said combustion chamber and a flue gas substantially free of unburned fuel at said outlet end of said combustion chamber;

(e) maintaining said first and second toroidal vortices in said combustion chamber for a residence time sufficient for said first and second toroidal vortices to naturally collapse and the flow of fluids in said combustion chamber to assume a uniform flow velocity across said combustion chamber and moving toward the outlet end of said combustion chamber; and (f) introducing water into said flue gas adjacent the outlet end of said combustion chamber to produce a mixture of said flue gas and said water and vaporize a major portion of said water to produce a mixture of said flue gas and steam.

2. A method in accordance with claim 1 wherein the fuel is introduced into the combustion chamber as a divergent spray.

3. A method in accordance with claim 1 wherein the diameter of the thus formed body of the fuel and the combustion supporting gas is reduced adjacent the downstream end of the mixing chamber and is then expanded into the combustion chamber.

4. A method in accordance with claim 1 wherein at least one of the relative volumes of the first and second volumes of combustion supporting gas and the relative pressures of introduction of said first and second volumes of combustion supporting gas are maintained such that the first torroidal vortex naturally collapses before the second torroidal vortex naturally collapses.

5. A method in accordance with claim 1 wherein the flow of fluids in the combustion chamber is altered to cause collapse of at least the second torroidal vortex at a residence time within the combustion chamber which is shorter than that residence time at which said at least said second torroidal vortex would naturally collapse.

6. A method in accordance with claim 5 wherein the flow of fluids in the combustion chamber is altered by reducing the diameter of the fluids flowing through said combustion chamber before said flowing fluids reach the downstream end of the combustion chamber and thereafter expanding the diameter of said flowing fluids to the full diameter of said combustion chamber.

7. A method in accordance with claim 6 wherein the second volume of combustion supporting gas is between a small amount, sufficient to thus produce the annular body of said second volume of combustion supporting gas, and about 75% of the total volume of the first and said second volumes of combustion supporting gas.

8. A method in accordance with claim 1 wherein the flame speed in the combustion chamber is maintained substantially in excess of laminar flame speed.

9. A method in accordance with claim 8 wherein the flame speed, at flame temperature, is maintained above about 5 ft. per second.

10. A method in accordance with claim 1 wherein the water is introduced in a generally radial direction.

11. A method in accordance with claim 10 wherein the water is introduced in a generally radial direction from a plurality of points spaced about the periphery of the combustion chamber.

12. A method in accordance with claim 1 wherein one of the flue gas or the mixture of flue gas and water is abruptly expanded adjacent the location of introduction of said water.

13. A method in accordance with claim 12 wherein one of the flue gas and the mixture of flue gas and water is abruptly expanded at an angle greater than 15° relative to the wall of the combustion chamber.

14. A method in accordance with claim 12 wherein one of the flue gas or the mixture of flue gas and water is reduced in diameter immediately prior to the abrupt expansion.

15. A method in accordance with claim 14 wherein the water is introduced into one of the flue gas at the reduced diameter portion of the same.

16. A method in accordance with claim 1 wherein the mixture of flue gas and water is maintained in a vaporization chamber for a time sufficient to vaporize a major portion of said water.

17. A method in accordance with claim 16 wherein the mixture of flue gas and water is maintained in the vaporization chamber for a time sufficient to vaporize at least 80% of said water.

18. A method in accordance with claim 1 wherein the water is passed as an annular stream about the outside wall of the combustion chamber prior to introduction of said water into the flue gas.

19. A method in accordance with claim 1 or 2 wherein the volume of fuel is sufficient to produce a power output of at least about 7 MM Btu/hr. at the outlet end of the combustion chamber.

20. A method in accordance with claim 1 or 2 wherein the volume of fuel is sufficient to produce a heat release of at least about 50 MM Btu/hr. ft.$^3$ at the outlet end of the combustion chamber.

21. A method in accordance with claim 1 or 2 wherein the output pressure of the mixture of flue gas and steam is at least about 300 psi.

22. A method in accordance with claim 1 or 2 wherein the fuel is heated to a temperature of between about ambient temperature and about 450° F. prior to introduction into the combustion chamber.

23. A method in accordance with claim 1 or 2 wherein the volume of combustion supporting gas is about 3% in excess of the stoichiometric amount.

24. A method in accordance with claim 1 or 2 wherein the relative velocity of the fluids in the combustion chamber is maintained between about 10 and about 200 ft. per second.

25. A method in accordance with claim 1 or 2 wherein the flow velocity within the combustion chamber, at flame temperature, is maintained between about 5 and 1,000 ft. per second.

26. A method in accordance with claim 1 or 2 wherein the combustion supporting gas is air and said air is heated to a temperature between about ambient temperature and about 800° F. prior to introduction into the combustion chamber.

27. A method in accordance with claim 1 or 2 wherein the fuel is a normally gaseous fuel.

28. A method in accordance with claim 1 or 2 wherein the fuel is a normally liquid fuel.

29. A method in accordance with claim 1 or 2 wherein the fuel is a normally solid, essentially ashless fuel.

30. A method in accordance with claim 1 wherein the second volume of combustion supporting gas is between a small amount, sufficient to form the annular body of said second volume of combustion supporting gas, and about 75% of the total volume of the first volume of combustion supporting gas and said second volume of combustion supporting gas.

31. A method of generating steam comprising:

(a) introducing a fuel and at least a first volume of a combustion supporting gas into a mixing chamber having its downstream end in open communication with an elongated combustion chamber;

(b) creating a confined toroidal vortex of said fuel and at least said first volume of said combustion supporing gas, in a volume at least equal to the stoichiometric volume necessary for the combustion of all said fuel, said vortex having its center adjacent the center of said elongated combustion chamber and rotating in one of a clockwise or counterclockwise direction to produce a body of said fuel and said combustion supporting gas moving from the inlet end of said combustion chamber toward the outlet end of said combustion chamber;

(c) burning said fuel in the presence of said combustion supporting gas to produce a flame moving from said inlet end of said combustion chamber toward said outlet end of said combustion chamber and a flue gas substantially free of unburned fuel at said outlet end of said combustion chamber;

(d) introducing water into said flue gas adjacent the outlet end of said combustion chamber to produce a mixture of said flue gas and said water and vaporize a major portion of said water to produce a mixture of said flue gas and steam; and (e) maintaining a pressure in the combustion chamber sufficient to produce choked flow of the mixture of flue gas and steam.

32. A method in accordance with claim 31 which further includes reducing the cross sectional dimension of the mixture of flue gas and steam to a cross sectional dimension such that said mixture of flue gas and steam exits at said choked flow velocity.

* * * * *